US012358674B2

(12) United States Patent
Yamane et al.

(10) Patent No.: US 12,358,674 B2
(45) Date of Patent: Jul. 15, 2025

(54) BAG-MAKING AND PACKAGING MACHINE

(71) Applicant: ISHIDA CO., LTD., Kyoto (JP)

(72) Inventors: Masayuki Yamane, Ritto (JP); Satoshi Hashimoto, Ritto (JP); Ryota Nagashima, Ritto (JP); Masaki Shinkawa, Ritto (JP); Yuchuan Tong, Ritto (JP); Tomoko Koike, Ritto (JP); Tomoki Shibata, Ritto (JP); Hiroki Fujihara, Ritto (JP); Riku Murakami, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 2 days.

(21) Appl. No.: 18/607,548

(22) Filed: Mar. 18, 2024

(65) Prior Publication Data

US 2024/0317443 A1 Sep. 26, 2024

(30) Foreign Application Priority Data

Mar. 20, 2023 (JP) ..... 2023-044529
Sep. 13, 2023 (JP) ..... 2023-148592

(51) Int. Cl.
*B65B 57/02* (2006.01)
*B65B 41/16* (2006.01)

(52) U.S. Cl.
CPC ..... *B65B 57/02* (2013.01); *B65B 41/16* (2013.01)

(58) Field of Classification Search
CPC ..... B65B 57/02; B65B 41/16
See application file for complete search history.

(56) References Cited

U.S. PATENT DOCUMENTS 4,840,320 A * 6/1989 Shigeta ..... B65H 19/1873 242/562.1
5,501,066 A * 3/1996 Errasti Iriarte ..... B65B 57/12 53/221

(Continued)

FOREIGN PATENT DOCUMENTS

EP 0524828 A1 * 1/1993 ..... B65B 9/20
JP 2020059508 A 4/2020

OTHER PUBLICATIONS

Screenshots from "Explanatory video of the FBP-800E Blister Packaging Machine," published by CKD Corporation on Aug. 17, 2021, in YouTube platform: https://www.youtube.com/watch?v=tbtbaXquoSU.

(Continued)

*Primary Examiner* — Lucas E. A. Palmer
(74) *Attorney, Agent, or Firm* — United IP Counselors, LLC

(57) ABSTRACT

A bag-making and packaging machine includes a bag-making and packaging section and a film supply section. The film supply section includes a film conveyance section that conveys a starting end portion of a replacement film roll supported by a film roll support portion to a bonding portion. The film conveyance section includes a clamping portion that holds a tape adhering to the starting end portion of the replacement film roll, and a pulling mechanism that pulls a second film held by the clamping portion from the replacement film roll. When the replacement film roll is mounted, the film roll support portion rotates the replacement film roll, and the clamping portion holds the tape of the replacement film roll rotated by the film roll support portion.

8 Claims, 21 Drawing Sheets

(56) References Cited

U.S. PATENT DOCUMENTS

| | | | | |
|---|---|---|---|---|
| 5,779,179 | A * | 7/1998 | Zentmyer | B65B 67/085 242/596.5 |
| 11,427,365 | B2 | 8/2022 | Shimoda et al. | |
| 11,707,099 | B1 * | 7/2023 | Aguilar | D05B 35/06 156/361 |
| 2004/0065047 | A1 * | 4/2004 | Miyamoto | B65H 20/34 53/64 |
| 2004/0112527 | A1 * | 6/2004 | Keene | B65H 23/1886 156/304.6 |
| 2011/0023423 | A1 * | 2/2011 | Iwasaki | B65H 20/10 53/510 |
| 2017/0137247 | A1 * | 5/2017 | Sato | B65H 19/1842 |
| 2018/0057294 | A1 * | 3/2018 | Ichikawa | B65H 26/063 |
| 2020/0108959 | A1 * | 4/2020 | Shimoda | B65B 41/16 |
| 2020/0108960 | A1 * | 4/2020 | Shimoda | B65B 51/16 |
| 2020/0172272 | A1 * | 6/2020 | Cittadino | B65B 57/02 |
| 2022/0081144 | A1 * | 3/2022 | Tong | B65H 26/02 |
| 2024/0017948 | A1 * | 1/2024 | Yamane | B65H 19/12 |
| 2024/0017949 | A1 * | 1/2024 | Ichikawa | B65B 59/003 |
| 2024/0083705 | A1 * | 3/2024 | Yamane | B65H 19/123 |
| 2024/0199255 | A1 * | 6/2024 | Roos | B65H 19/1852 |

OTHER PUBLICATIONS

Extended European Search report issued in counterpart European Application No. 24163617.4, dated Sep. 2, 2024.

* cited by examiner

BAG-MAKING AND PACKAGING MACHINE

TECHNICAL FIELD

The claimed invention relates to a bag-making and packaging machine.

BACKGROUND

A bag-making and packaging machine includes a bag-making and packaging section that forms a sheet-form film into a tubular shape and seals the film formed into the tubular shape to form the film into a bag shape, and a film supply section that holds a film roll in which the sheet-form film is wound, and supplies the film fed from the film roll to the bag-making and packaging section. The film supply section includes a film roll support portion that rotatably supports one film roll, a film temporary placement portion on which the vicinity of a starting end portion of the film wound in the film roll is manually temporarily placed when attaching the film roll to the film roll support portion, a rotation mechanism that rotates the film roll supported by the film roll support portion, a starting end portion detection sensor that detects that the starting end portion of the film is positioned at a normal position, and a control unit of the rotation mechanism that causes the rotation mechanism to rotate the film roll to convey the film along a predetermined conveyance path until the starting end portion detection sensor detects that the starting end portion of the film is positioned at the normal position after the vicinity of the starting end portion of the film is temporarily placed on the film temporary placement portion (see, for example, Japanese Unexamined Patent Publication No. 2020-59508).

In a factory or the like in which the bag-making and packaging machine is installed, automation of all processes is desired. In the case of the bag-making and packaging machine according to the related art, it is necessary for an operator to temporarily place the film on the film temporary placement unit. Therefore, automation of replacement of the film roll cannot be implemented in the bag-making and packaging machine according to the related art.

SUMMARY

An object of one aspect of the claimed invention is to provide a bag-making and packaging machine capable of automatically replacing a film roll.

A bag-making and packaging machine according to one aspect of the claimed invention is a bag-making and packaging machine including: a bag-making and packaging section configured to form a sheet-form film into a tubular shape and seal the film formed into a tubular shape to form the film into a bag shape; and a film supply section configured to hold a film roll in which the sheet-form film is wound and sequentially supply the film fed from the film roll to the bag-making and packaging section, in which the film supply section includes a film roll support portion configured to rotatably support the film roll, a bonding portion configured to bond a terminal end portion of the film roll that supplies the film to the bag-making and packaging section and a starting end portion of the film roll for replacement, and a film conveyance section configured to convey the starting end portion of the film roll for replacement supported by the film roll support portion to the bonding portion, the film conveyance section includes a holding portion configured to hold the starting end portion of the film roll for replacement or a tape adhering to the starting end portion, and a pulling portion configured to pull the film held by the holding portion from the film roll, the film roll support portion rotates the film roll when the film roll for replacement is mounted, and the holding portion holds the starting end portion of the film roll rotated by the film roll support portion or the tape.

In the bag-making and packaging machine according to one aspect of the claimed invention, the film supply section includes the film conveyance section that conveys the starting end portion of the film roll supported by the film roll support portion to the bonding portion. The film conveyance section includes the holding portion that holds the starting end portion of the film roll for replacement or the tape adhering to the starting end portion, and the holding portion holds the starting end portion of the film roll rotated by the film roll support portion or the tape. As a result, in the bag-making and packaging machine, the starting end portion of the film roll for replacement or the tape can be held and conveyed to the film supply section. Therefore, in the bag-making and packaging machine, no work by an operator is required for replacement of the film roll. Therefore, in the bag-making and packaging machine, the film roll can be automatically replaced.

The bag-making and packaging machine may further include: a detection portion configured to detect a mark for position adjustment provided on the film roll for replacement; and a control unit configured to stop conveyance of the film in the film conveyance section based on a detection result of the detection portion. With this configuration, it is possible to appropriately align printed contents of packaging and the like at a terminal end portion of the film roll that supplies the film to the bag-making and packaging section and the starting end portion of the film roll for replacement.

In the bag-making and packaging machine, after the conveyance of the film by the film conveyance section is stopped, the starting end portion of the film may be cut, and the holding of the film by the holding portion may be released. With this configuration, the starting end portion of the film roll for replacement that is unnecessary for alignment can be removed.

In the bag-making and packaging machine, the holding portion may hold the starting end portion of the film roll or the tape at a height position above a center of a diameter of the film roll for replacement in a vertical direction. With this configuration, the holding portion enters with an angle with respect to the starting end portion or the tape unlike the case of holding the starting end portion of the film roll or the tape at the center of the diameter of the film roll. Therefore, the starting end portion of the film roll or the tape can be more reliably held by the holding portion.

The bag-making and packaging machine may further include a moving mechanism configured to move the holding portion in a vertical direction. With this configuration, the holding portion can be moved in the vertical direction, and thus, the holding portion can hold the starting end portion of the film roll or the tape at an appropriate height position.

In the bag-making and packaging machine, the film conveyance section may further include a guide portion configured to guide the starting end portion of the film roll or the tape to the holding portion, and the guide portion may be subjected to non-adhesive processing. With this configuration, it is possible to suppress the film roll from adhering to the guide portion. Therefore, it is possible to avoid a situation in which the film roll adheres to the guide portion and cannot thus be appropriately guided to the holding portion.

In the bag-making and packaging machine, the holding portion may include a roller disposed at a position facing the film roll. With this configuration, when the holding portion holds the starting end portion of the film roll or the tape, the roller can suppress breakage or the like of the film roll.

In the bag-making and packaging machine, the film supply section may feed the film from the film roll by rotating the film roll support portion, the film conveyance section may further include a guide portion configured to guide the film fed by the film supply section or the tape attached to the film, and a detection portion configured to detect the film or the tape guided on the guide portion, the holding portion may hold the film or the tape guided on the guide portion and pull the film from the film roll, the bag-making and packaging machine may further include a control unit configured to control rotation of the film roll support portion, and in a case where the control unit determines that the holding of the film or the tape has failed in the holding portion based on a detection result of the detection portion, the control unit may rotate the film roll support portion in such a way that the film or the tape is detected again by the detection portion. With this configuration, even in a case where the holding of the film or the like has failed in the holding portion, the film can be guided again to the guide portion. Therefore, in the bag-making and packaging machine, it is possible to retry the holding of the film or the like by the holding portion. Therefore, in the bag-making and packaging machine, a success rate of replacement of the film roll can be improved. As a result, a decrease in yield can be suppressed.

In the bag-making and packaging machine, in a case where the detection portion does not detect the film or the tape after a lapse of a predetermined time set in advance such that the film or the tape reaches the holding portion after the detection portion detects the film or the tape, the control unit may determine that the holding of the film or the tape has failed in the holding portion. In a case where the film or the like is not held by the holding portion after the film or the like is detected by the detection portion, the detection portion does not detect the film or the like after the detection. Therefore, it is possible to more accurately determine the failure by determining the failure in holding the film or the like by the above-described method.

In the bag-making and packaging machine, in a case where the control unit determines that the holding of the film or the tape has failed in the holding portion, the control unit may change the predetermined time. With this configuration, the holding of the film or the like by the holding portion can be easily performed by changing the predetermined time.

In the bag-making and packaging machine, in a case where the control unit determines that the holding of the film or the tape has failed a predetermined number of times in the holding portion, the control unit may stop driving of the film supply section. In a case where there are multiple failures in holding the film or the like, there may be some kind of problem. In this case, the film or the like cannot be held no matter how many times the operation is performed. Therefore, in a case where the holding of the film or the like has failed a predetermined number of times, the driving of the film supply section is stopped, so that the operator can work to solve the problem.

According to one aspect of the claimed invention, it is possible to automatically replace a film roll.

DETAILED DESCRIPTION

Figure 1:
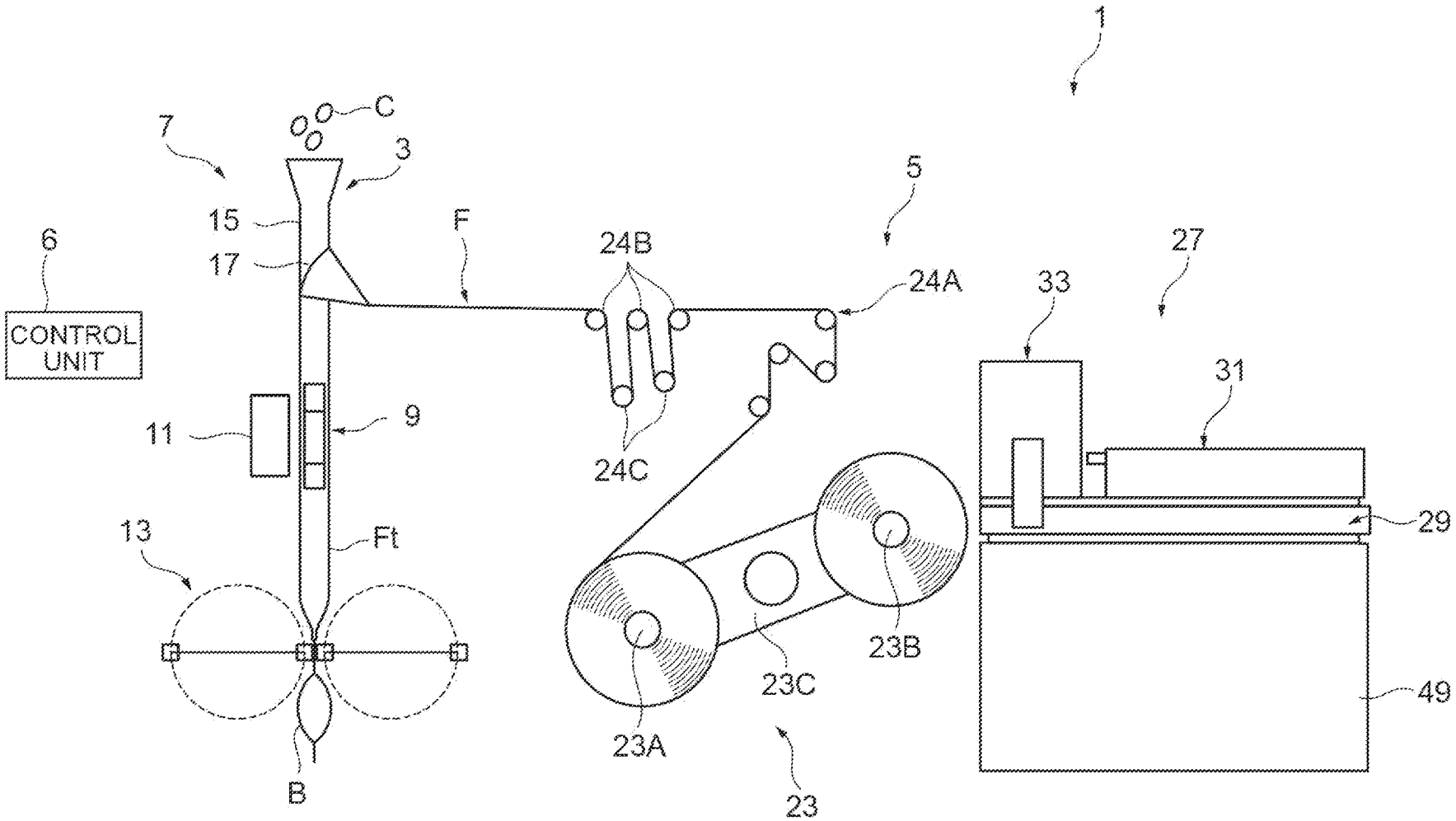
FIG. 1 is a schematic diagram illustrating a bag-making and packaging machine.

Hereinafter, preferred embodiments of the claimed invention will be described in detail with reference to the accompanying drawings. In the description of the drawings, the same or corresponding elements are denoted by the same reference signs, and an overlapping description is omitted. In the following description, the terms "front", "rear", "upper", "lower", "left", "right", and the like may be used to represent directions. In the present embodiment, "front", "rear", "upper", "lower", "left", and "right" are defined by the directions of arrows in the drawings.

Figure 2:
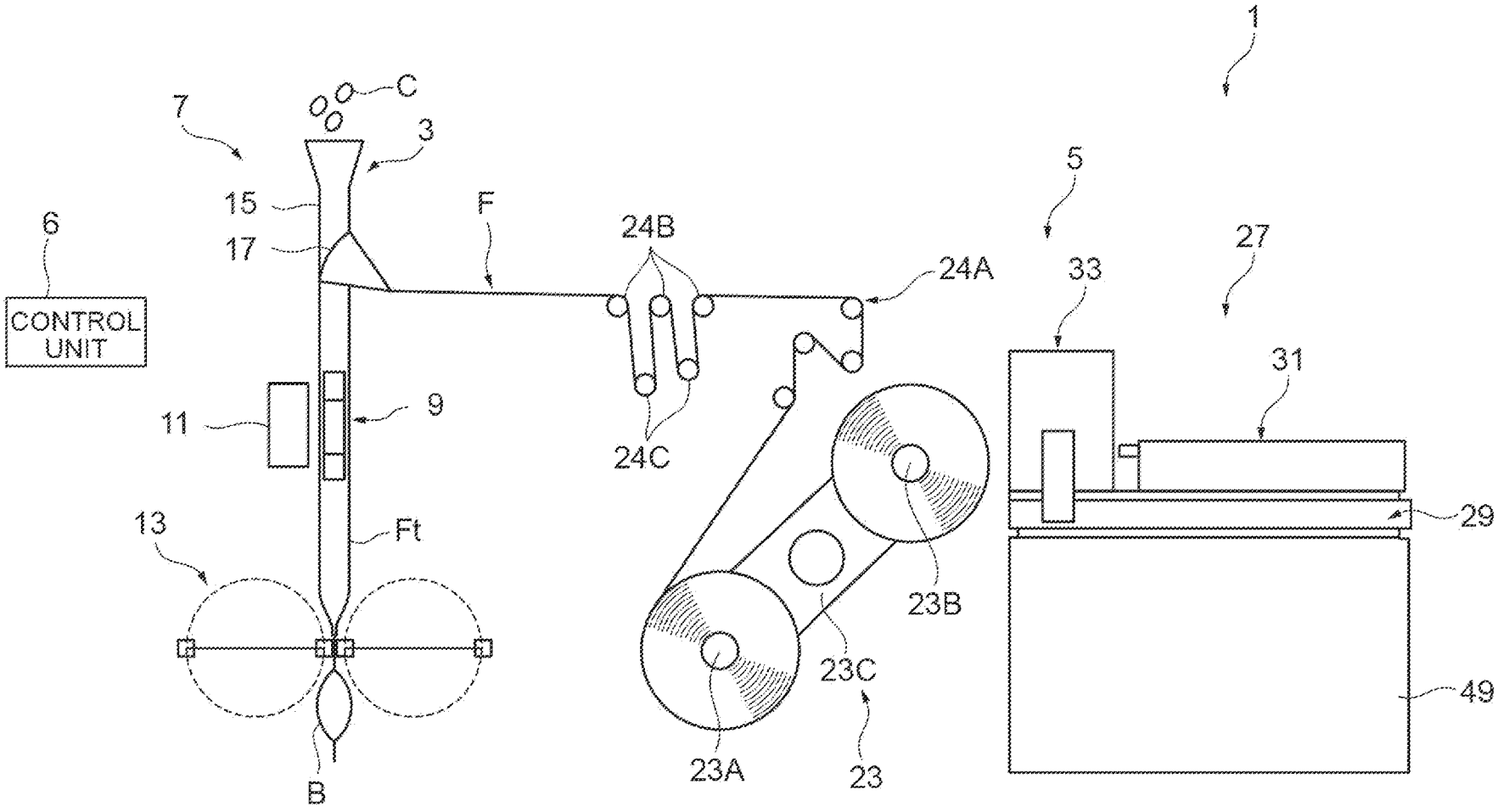
FIG. 2 is a schematic diagram illustrating the bag-making and packaging machine.

As illustrated in FIGS. 1 and 2, a bag-making and packaging machine 1 is a device used to manufacture a bag B accommodating an article C supplied from a combination weighing device (not illustrated) or the like. The bag-making and packaging machine 1 includes a bag-making and packaging section 3, a film supply section 5, and a control unit 6.

[Bag-Making and Packaging Section] The bag-making and packaging section 3 forms a sheet-form film F into a tubular shape and seals the film F formed into a tubular shape to form the film F into a bag shape. The bag-making and packaging section 3 includes a former unit 7, a pair of film conveyance belts 9, a vertical sealing mechanism 11, and a horizontal sealing mechanism 13. FIGS. 1 and 2 illustrate one of the pair of film conveyance belts 9.

The former unit 7 includes a tube 15 and a former body 17. The tube 15 is a cylindrical member extending in a vertical direction and having upper and lower end portions opened. The tube 15 receives the article C supplied from the combination weighing device from the upper opening. The tube 15 supplies the article C into a tubular film Ft. The former body 17 bends the sheet-form film F drawn out from a film roll FR and conveyed to the former body 17 in such a way that a left side or edge portion and a right side or edge portion of the film F overlap each other to form the film F into a tubular shape. The tubular film Ft formed by the former body 17 is guided in such a way as to be wound around an outer peripheral surface of a lower side of the tube 15, and is conveyed downward in a state of being wound around the tube 15.

The pair of film conveyance belts 9 are disposed below the former unit 7. The pair of film conveyance belts 9 are disposed on a left side and a right side of the tube 15 of the former unit 7 around which the tubular film Ft is wound. The pair of film conveyance belts 9 convey the film F drawn out from the film roll FR to the former body 17. The film conveyance belts 9 convey the tubular film Ft formed by the former body 17 to the horizontal sealing mechanism 13. The film conveyance belts 9 adhere to and convey the tubular film Ft wound around the tube 15 downward.

The vertical sealing mechanism 11 is a mechanism that vertically seals (seals in the vertical direction) an overlapping portion of the tubular film Ft wound around the tube 15. The vertical sealing mechanism 11 includes a heater (not illustrated), a heater belt (not illustrated) that comes into contact with the overlapping portion of the tubular film Ft, and a drive mechanism (not illustrated) that drives the heater belt. The heater heats the heater belt. The drive mechanism drives the heater belt in a front-rear direction in such a way that the heater belt approaches the tube 15 or the heater belt moves away from the tube 15. The vertical sealing mechanism 11 presses the heated heater belt against the tube 15 at a predetermined pressure at the overlapping portions of the tubular film Ft to thermally seal the overlapping portions of the tubular film Ft in the vertical direction. The vertical sealing mechanism 11 may seal the tubular film Ft with a heater block instead of the heater belt.

The horizontal sealing mechanism 13 is a mechanism that horizontally seals the tubular film Ft that has been vertically sealed by the vertical sealing mechanism 11 and conveyed downward by the film conveyance belts 9. The horizontal sealing mechanism 13 includes a cutter (not illustrated). The cutter cuts a horizontally sealed portion of the tubular film Ft at the center position of the tubular film Ft in a conveyance direction to separate the bag B and the subsequent tubular film Ft from each other.

[Film Supply Section] The film supply section 5 holds the film roll FR in which the sheet-form film F is wound, and sequentially supplies the film F fed from the film roll FR to the bag-making and packaging section 3. The film F supplied from the film supply section 5 is guided by multiple rollers 24A, 24B, and 24C disposed along a conveyance path of the film F and conveyed to the bag-making and packaging section 3. The roller 24B is a fixed roller, and the roller 24C is a movable roller. The roller 24B and the roller 24C constitute a tension adjusting mechanism. In the tension adjusting mechanism, a force is applied to the film F by the roller 24C, so that a tension of the conveyed film F is adjusted.

The film supply section 5 includes a film roll support mechanism 23, a bonding portion 25 (see FIG. 19), and a film conveyance section 27.

The film roll support mechanism 23 includes a first film roll support portion 23A, a second film roll support portion 23B, a support frame 23C, and a feeding mechanism (not illustrated).

The first film roll support portion 23A and the second film roll support portion 23B each rotatably support the film roll FR. The film roll FR is mounted on (inserted onto) each of the first film roll support portion 23A and the second film roll support portion 23B. In the example illustrated in FIGS. 1 and 2, the film roll FR for supplying the film F to the bag-making and packaging section 3 (hereinafter, also referred to as a "used film roll FR") is mounted on the first film roll support portion 23A, and the film roll FR for replacement (hereinafter, also referred to as a "replacement film roll FR") is mounted on the second film roll support portion 23B.

The support frame 23C supports the first film roll support portion 23A and the second film roll support portion 23B. The support frame 23C is rotatably provided. The support frame 23C is rotated by a drive portion (not illustrated). As the support frame 23C is rotated, the first film roll support portion 23A and the second film roll support portion 23B rotate (turn).

The feeding mechanism feeds the film F from the film roll FR by rotating each of the first film roll support portion 23A and the second film roll support portion 23B.

The bonding portion 25 bonds a terminal end portion of the used film roll FR for supplying the film F to the bag-making and packaging section 3 and a starting end portion of the replacement film roll FR. In the present embodiment, the bonding portion 25 bonds a terminal end portion of a film F (hereinafter, also referred to as a "first film F") wound in the used film roll FR supported by the first film roll support portion 23A and a starting end portion of a film F (hereinafter, also referred to as a "second film F") wound in the replacement film roll FR supported by the second film roll support portion 23B. Here, the starting end portion and the terminal end portion of the film F each mean a portion including a predetermined length from an end (a starting end or a terminal end) of the film F.

The bonding portion 25 heats the first film F and the second film F by a heater (not illustrated) in a state where the first film F and the second film F are pressed together to thermally bond the first film F and the second film F. A method for the bonding is not limited to thermal bonding, and the first film F and the second film F may be bonded by ultrasonic bonding.

The film conveyance section 27 conveys the starting end portion of the replacement film roll FR supported by the second film roll support portion 23B to the bonding portion 25. The film conveyance section 27 includes a film roll detection unit 29, a clamping unit 31, a roller unit 33, and a film delivery section 35 (see FIG. 12).

Figure 3:
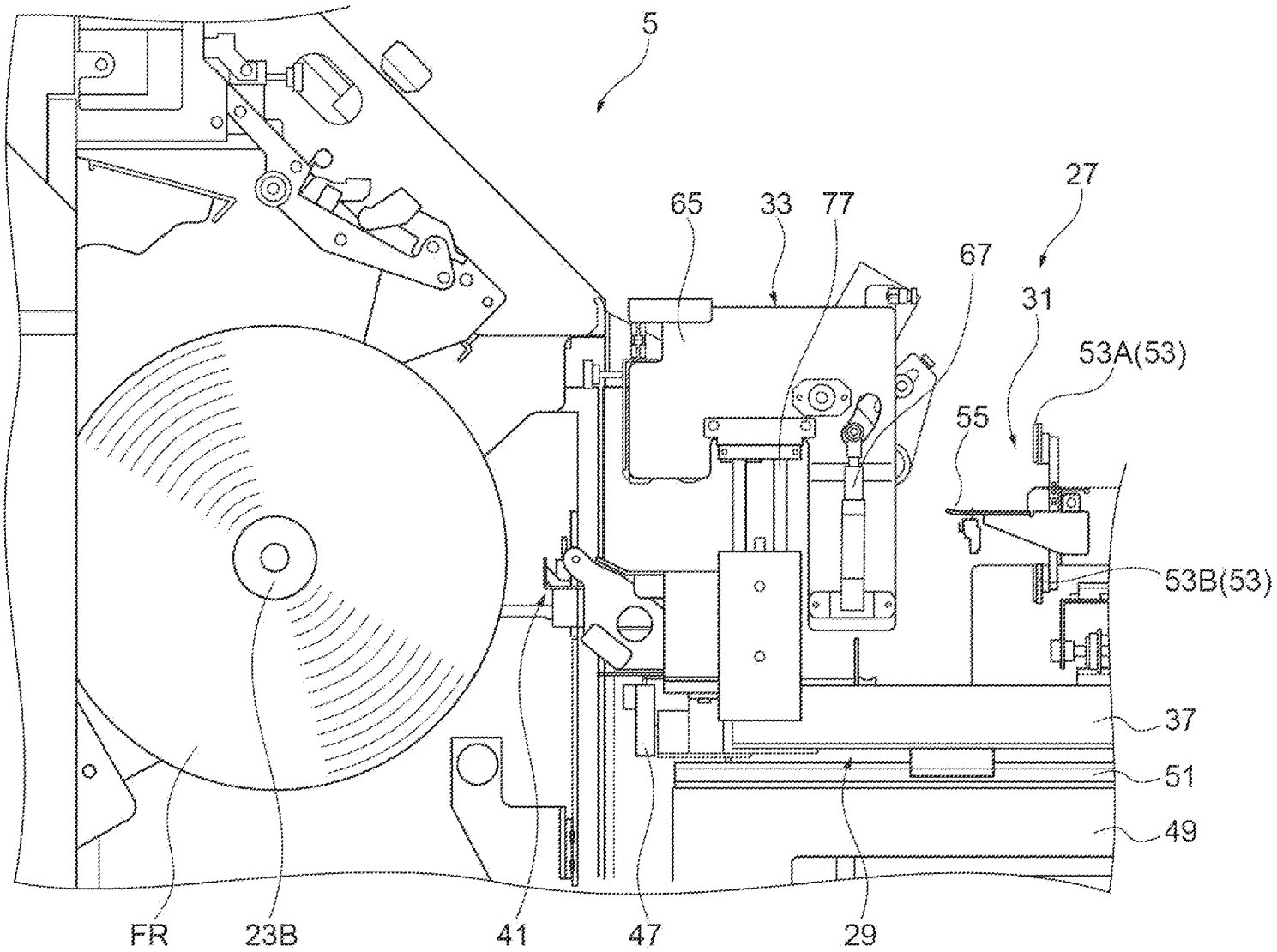
FIG. 3 is a close-up side view illustrating a part of the bag-making and packaging machine.
Figure 5:
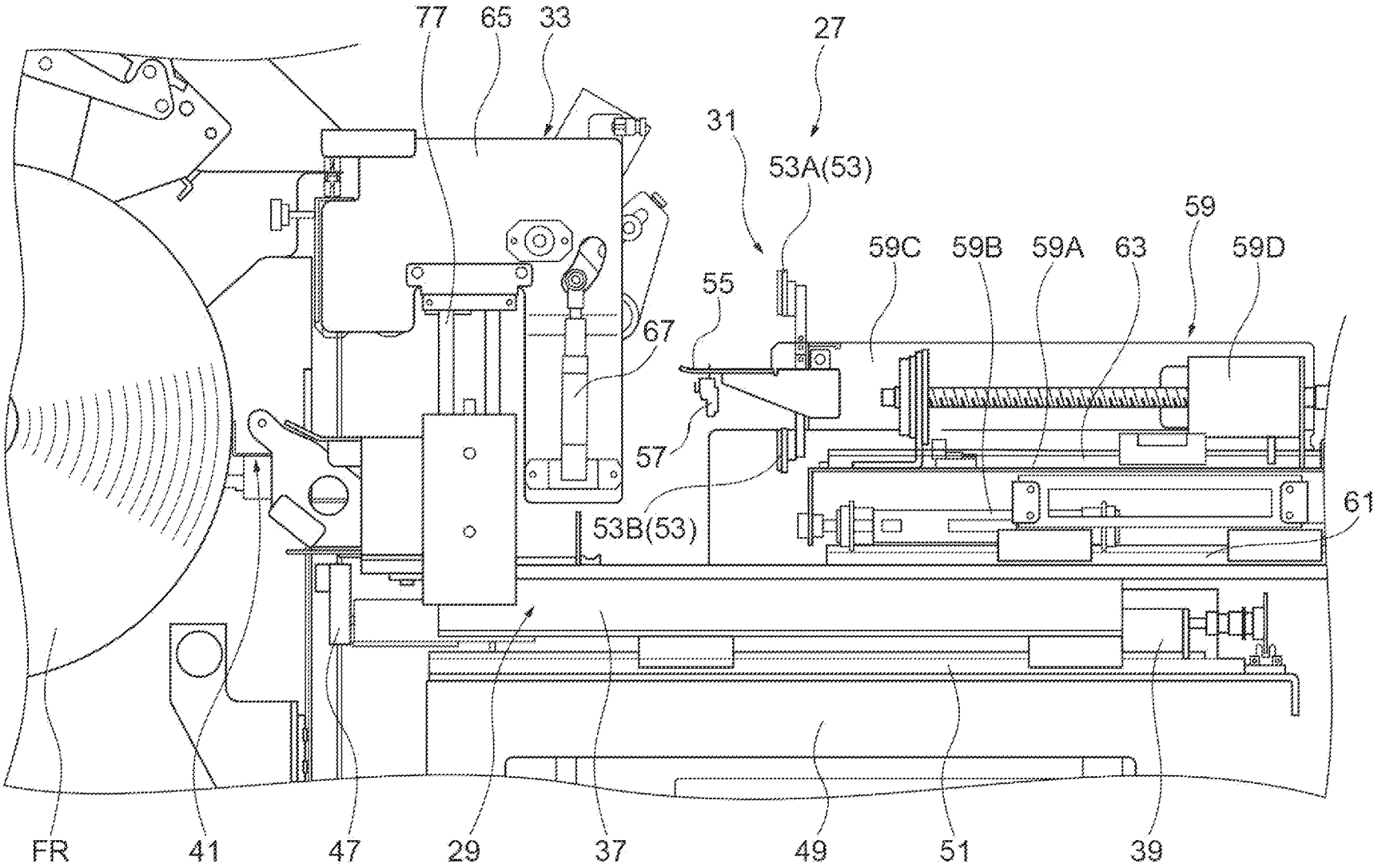
FIG. 5 is a side view illustrating a part of the bag-making and packaging machine.

As illustrated in FIGS. 3 and 5, the film roll detection unit 29 detects the replacement film roll FR supported by the second film roll support portion 23B. The film roll detection unit 29 includes a base portion 37, a drive portion 39, a detection portion 41, rollers 43A, 43B, and 43C, an insertion portion 45, and a clamping portion 47.

The base portion 37 is arranged to be movable in the front-rear direction on a rail 51 disposed on a support frame 49. The drive portion 39 drives the base portion 37. The drive portion 39 may, for example, be a stepping motor.

Figure 4B:
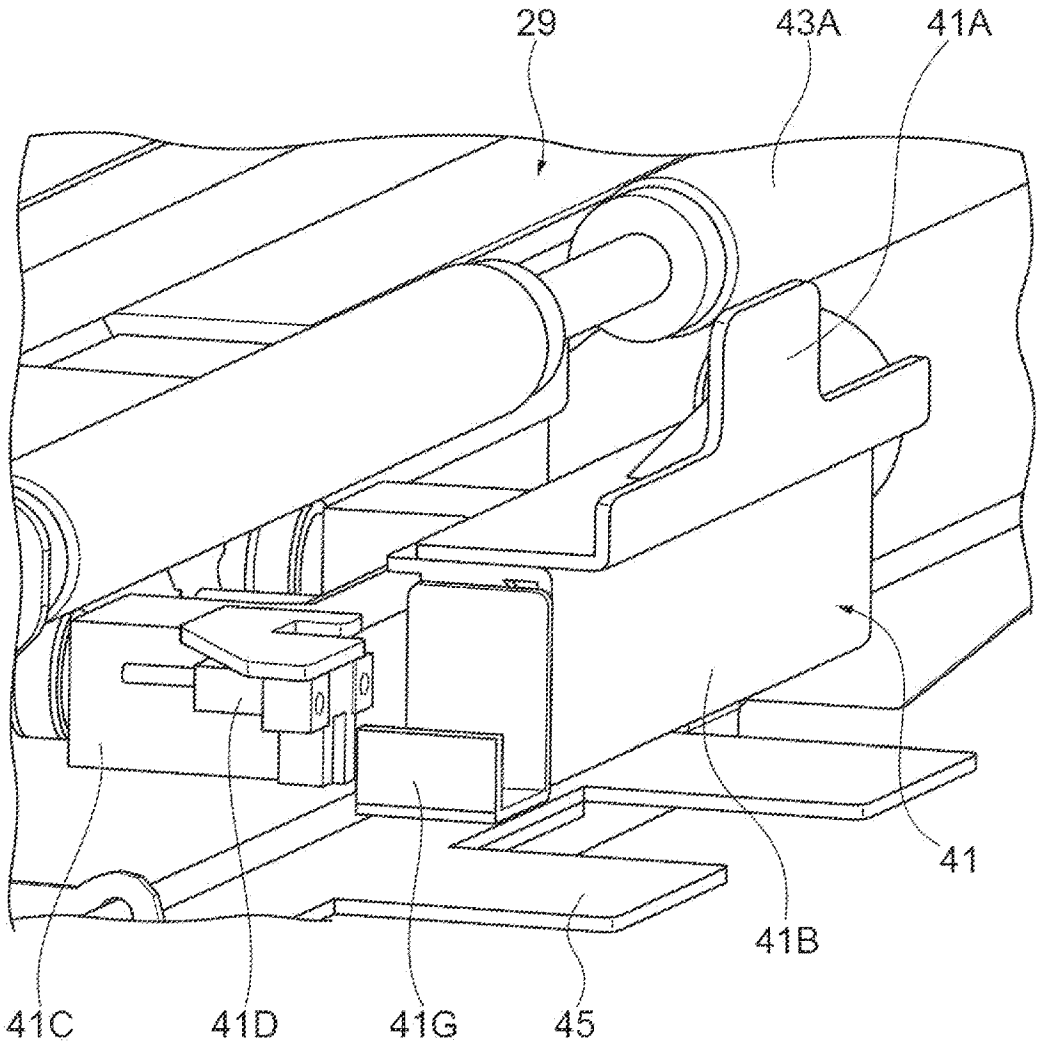
FIGS. 4A and 4B are perspective views illustrating a detection portion.
Figure 4A:
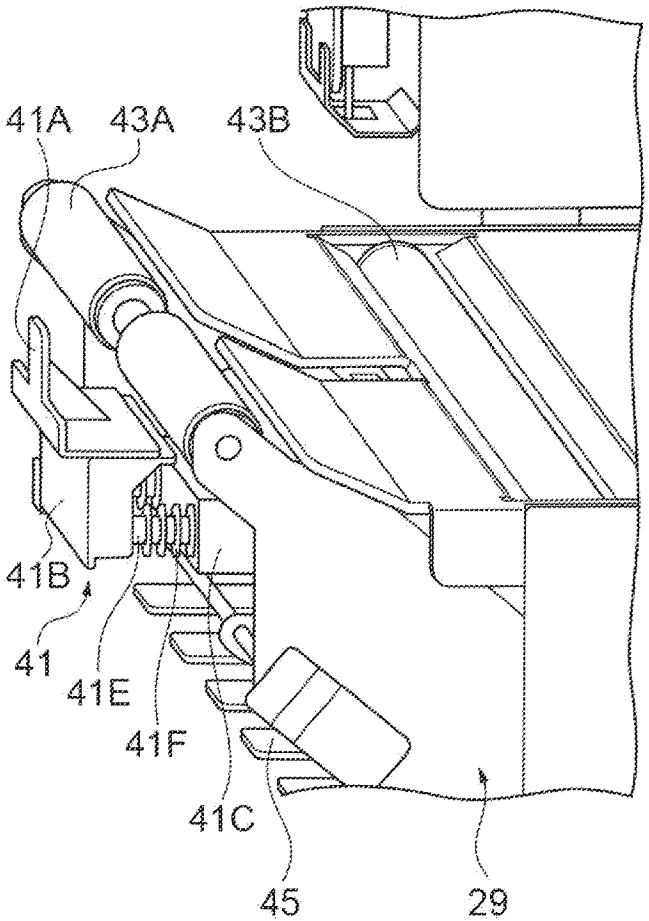

The detection portion 41 detects the replacement film roll FR. The detection portion 41 is installed at a front end portion of the base portion 37. As illustrated in FIGS. 4A and 4B, the detection portion 41 includes a contact portion 41A, a movable portion 41B, a main body portion 41C, and a sensor 41D.

The contact portion 41A is a portion that comes into contact with the replacement film roll FR. The contact portion 41A is fixed to the movable portion 41B. The movable portion 41B is arranged to be movable in the front-rear direction (a direction approaching the main body portion 41C and a direction away from the main body portion 41C) with respect to the main body portion 41C. The movable portion 41B includes a pair of guide portions 41E and 41E. Springs 41F and 41F are inserted through the guide portions 41E and 41E. The movable portion 41B is provided with a light shielding plate 41G.

The main body portion 41C is provided on the base portion 37. The main body portion 41C is movably provided on the base portion 37. The main body portion 41C is driven by the drive portion (not illustrated). The main body portion 41C moves between an origin position (see FIG. 6) and a contact position (see FIG. 4A). The contact position is a position in front of the origin position. The detection portion 41 is moved by the movement of the main body portion 41C. The sensor 41D may, for example, be a photocoupler sensor. When light is blocked by the light shielding plate 41G, the sensor 41D outputs a detection signal to the control unit 6.

The rollers 43A, 43B, and 43C (see FIG. 12) are rotatably provided on the base portion 37. The rollers 43A, 43B, and 43C are arranged at predetermined intervals in the front-rear direction.

The insertion portion 45 (see FIG. 4B) is a plate-shaped member. A front end portion of the insertion portion 45 has an uneven shape. The insertion portion 45 is arranged to be movable in the front-rear direction. The insertion portion 45 is driven by the drive portion (not illustrated).

The clamping portion 47 clamps the second film F with the film delivery section 35. The clamping portion 47 is arranged to be movable in the front-rear direction. The clamping portion 47 is driven by the drive portion (not illustrated). The drive portion may, for example, be an air cylinder.

In the film roll detection unit 29, when the base portion 37 moves forward (toward the replacement film roll FR) by the drive of the drive portion 39, the contact portion 41A of the detection portion 41 comes into contact with the replacement film roll FR. When the contact portion 41A comes into contact with the replacement film roll FR, the movable portion 41B moves rearward. At this time, the springs 41F contract. When the light shielding plate 41G shields the sensor 41D from light by the movement of the movable portion 41B, the sensor 41D detects the light shielding plate 41G. As a result, the replacement film roll FR is detected. A diameter of the replacement film roll FR is obtained based on a detection result of the sensor 41D.

The clamping unit 31 clamps (holds) the second film F of the replacement film roll FR. The clamping unit 31 includes a clamping portion (holding portion) 53, a guide portion 55, a sensor (detection portion) 57, and a pulling mechanism (pulling portion) 59.

The clamping portion 53 clamps the second film F. The clamping portion 53 is provided at a front end portion of the clamping unit 31 (a second moving portion 59C (described below) of the pulling mechanism 59). The clamping portion 53 includes a first clamping member 53A and a second clamping member 53B. In the clamping portion 53, the first clamping member 53A and the second clamping member 53B are arranged to be movable between a clamping position P1 (see FIG. 8A) and an open position P2 (see FIG. 8B). The first clamping member 53A and the second clamping member 53B are driven by the drive portion (not illustrated). A clamping surface 53Aa of the first clamping member 53A and a clamping surface 53Ba of the second clamping member 53B are configured in such a way that the clamped film F does not come off. The clamping surface 53Aa of the first clamping member 53A and the clamping surface 53Ba of the second clamping member 53B may be made of rubber or may be uneven surfaces.

Figure 9B:
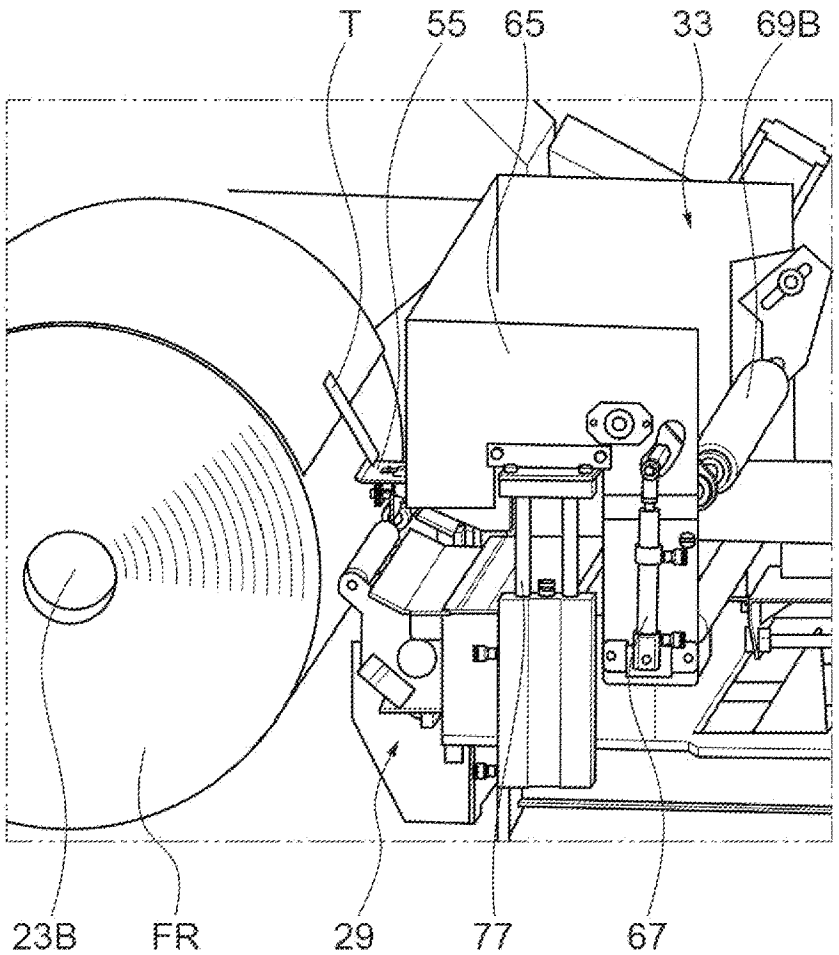
FIGS. 9A and 9B are views illustrating clamping of a tape by the clamping portion.
Figure 9A:
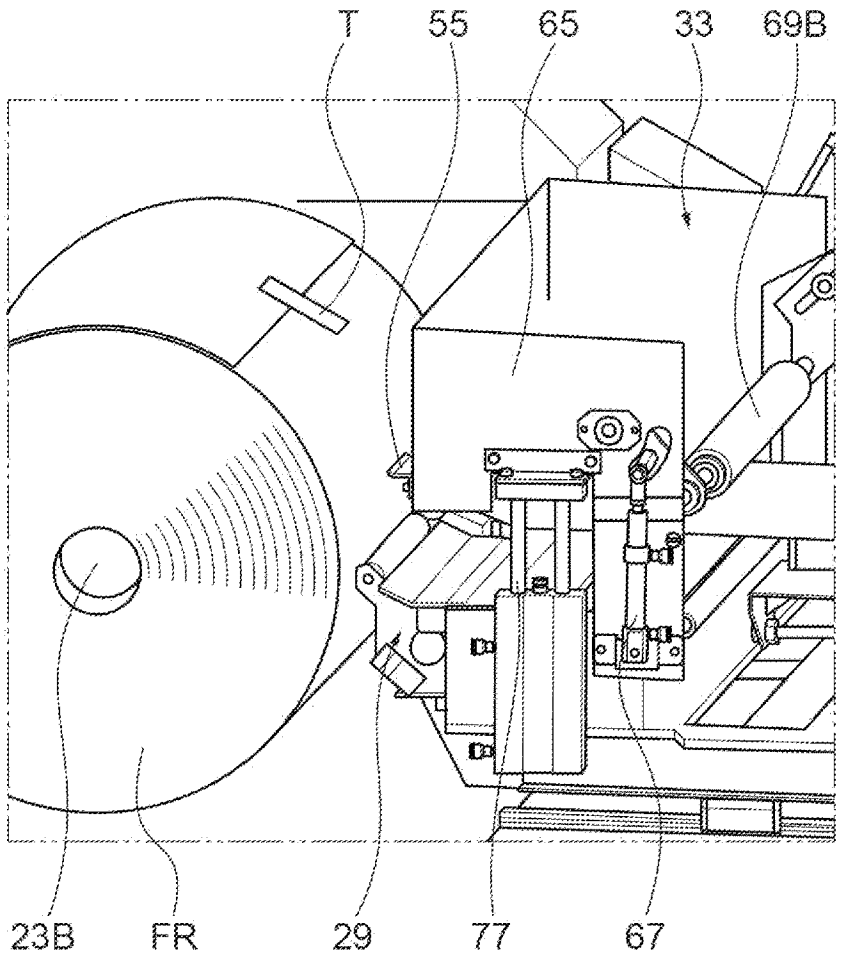

The guide portion 55 guides a tape T (see FIG. 9A) provided on the replacement film roll FR to the clamping portion 53. As illustrated in FIG. 9A, the tape T is provided at the starting end portion of the replacement film roll FR. The tape T adheres to the central portion of the replacement film roll FR in a length direction. A distal end portion of the tape T does not adhere to the replacement film roll FR.

As illustrated in FIGS. 3 and 5, the guide portion 55 is provided at the front end portion of the clamping unit 31. The guide portion 55 is a plate-like member. The guide portion 55 extends in the front-rear direction. In the present embodiment, a front end portion of the guide portion 55 is bent upward, for example. The front end portion of the guide portion 55 may be bent downward. The guide portion 55 is subjected to non-adhesive processing. For example, fluororesin coating, blast processing, or the like can be used as the non-adhesive processing. The guide portion 55 has an opening portion 55A (see FIG. 8B). The clamping portion 53 clamps the film F at the opening portion 55A of the guide portion 55.

The sensor 57 is attached to the guide portion 55. The sensor 57 detects the tape T through the opening portion 55A of the guide portion 55. The sensor 57 may, for example, be a reflective sensor. Once the tape T is detected, the sensor 57 outputs a detection signal to the control unit 6.

The pulling mechanism 59 pulls the second film F held by the clamping portion 53 from the replacement film roll FR. The pulling mechanism 59 includes a first moving portion 59A, a first drive portion 59B, a second moving portion 59C, and a second drive portion 59D.

The first moving portion 59A is arranged to be movable in the front-rear direction on a rail 61 installed on the base portion 37 of the film roll detection unit 29. The first drive portion 59B drives the first moving portion 59A. The first drive portion 59B may, for example, be an air cylinder. The second moving portion 59C is arranged to be movable in the front-rear direction on a rail 63 installed on the first moving portion 59A. The second drive portion 59D drives the second moving portion 59C. The second drive portion 59D may, for example, be a stepping motor.

The roller unit 33 includes a main body portion 65, a drive portion 67, rollers 69A and 69B, a sensor (detection portion) 71 (see FIG. 14B), a cutter 73 (see FIG. 14C), and an air injection portion 75. The main body portion 65 is disposed at the front end portion of the base portion 37 of the film roll detection unit 29. The main body portion 65 is arranged to be movable in the vertical direction by a moving portion 77 fixed to the base portion 37. The main body portion 65 moves upward by driving of the moving portion 77. When the moving portion 77 stops operating, the main body portion 65 moves downward (origin position) by its own weight. The drive portion 67 drives the roller 69B. The drive portion 67 may, for example, be an air cylinder.

The rollers 69A and 69B are rotatably provided in the main body portion 65. The roller 69A clamps the second film F together with the roller 43B of the film roll detection unit 29. The roller 69B clamps the second film F together with the roller 43C of the film roll detection unit 29. The roller 69B is rotated by the drive portion (not illustrated).

Figure 20:
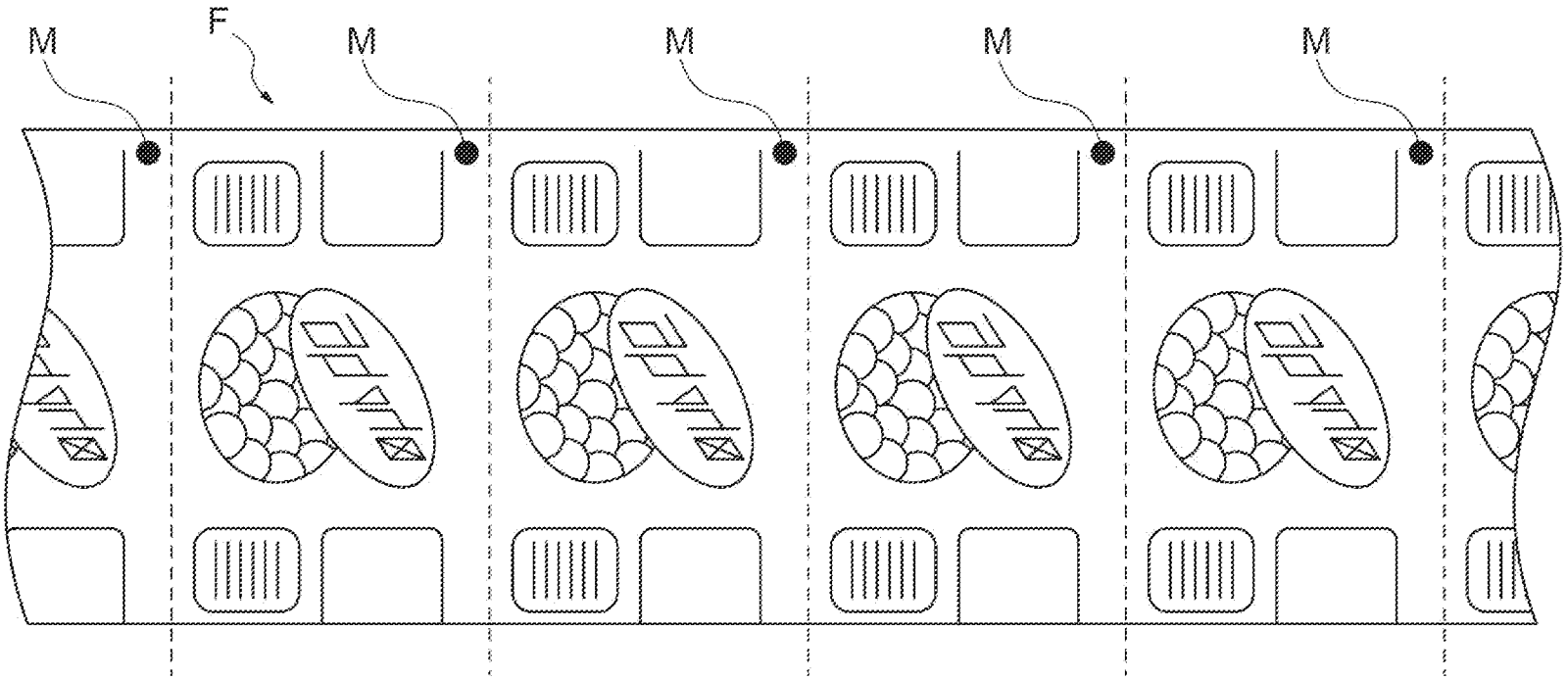
FIG. 20 is a diagram illustrating a film provided with a registration mark.

The sensor 71 detects a registration mark (a mark for position adjustment) M provided on the replacement film roll FR. As illustrated in FIG. 20, the registration marks M are printed on the replacement film roll FR at predetermined intervals. Once the registration mark M is detected, the sensor 71 outputs a detection signal to the control unit 6.

The cutter 73 cuts the starting end portion of the second film F fed from the replacement film roll FR.

The air injection portion 75 injects air to the second film F cut by the cutter 73.

Figure 12:
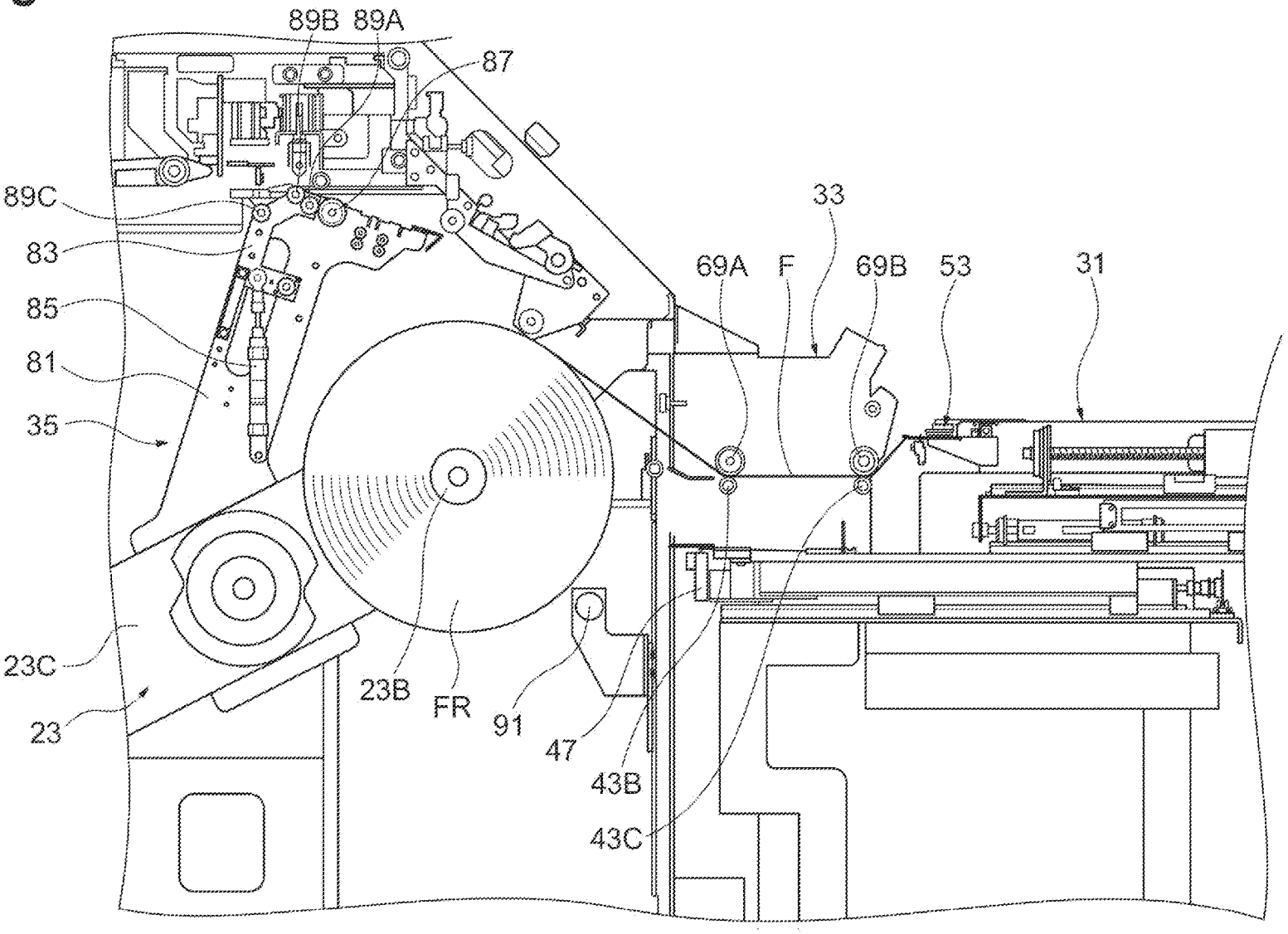
FIG. 12 is a side view illustrating an operation of the film conveyance section.
Figure 13:
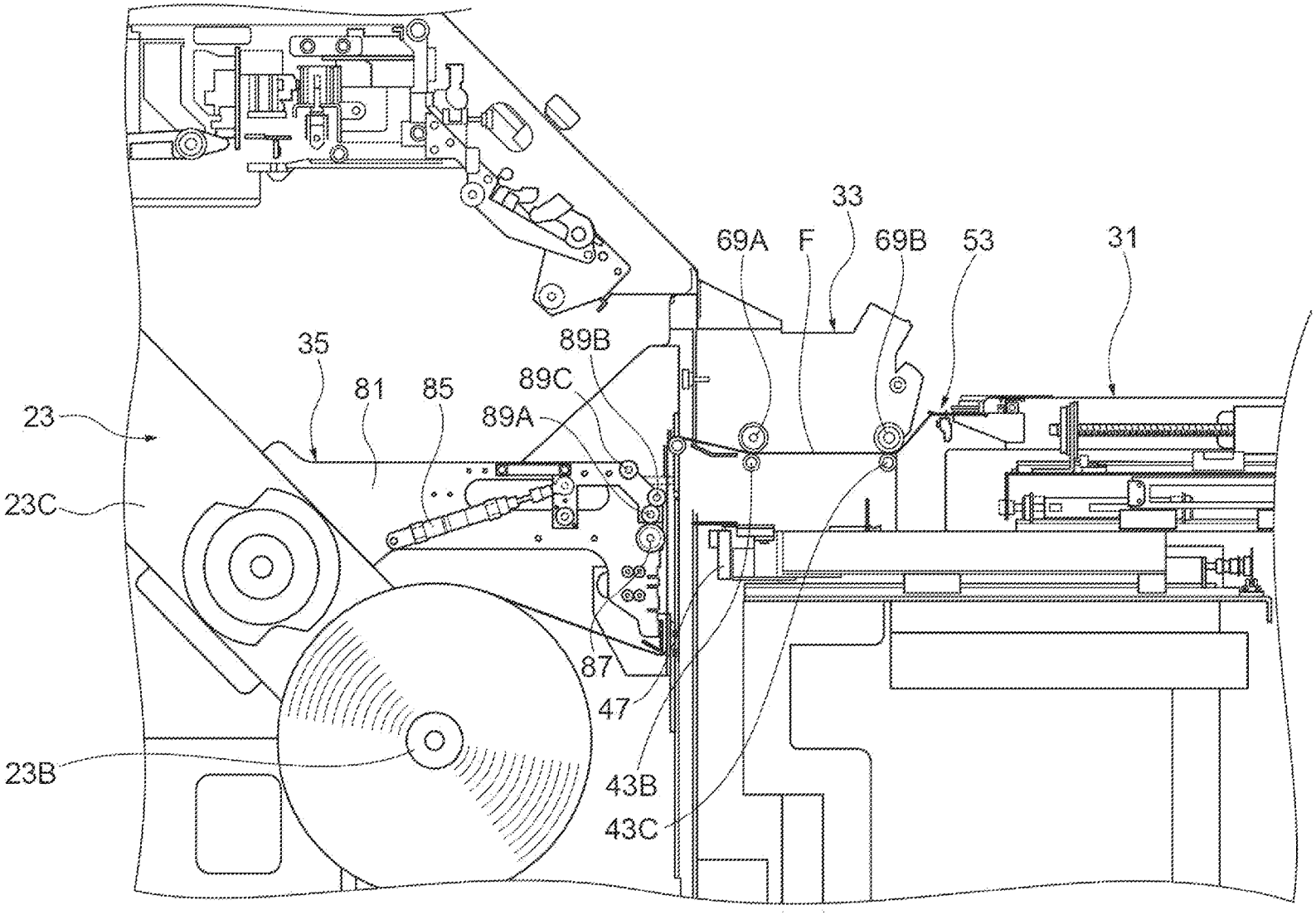
FIG. 13 is a side view illustrating the operation of the film conveyance section.

As illustrated in FIGS. 12 and 13, the film delivery section 35 delivers the second film F of the replacement film roll FR to the bonding portion 25. The film delivery section 35 includes an arm portion 81, a swinging portion 83, and a drive portion 85. The arm portion 81 is swingably provided. A roller 87 is provided at a distal end portion of the arm portion 81. The swinging portion 83 is swingably provided on the arm portion 81. The swinging portion 83 is provided with rollers 89A, 89B, and 89C. The drive portion 85 swings the swinging portion 83. The drive portion 85 may, for example, be an air cylinder.

[Control Unit] The control unit 6 controls an operation of the bag-making and packaging machine 1. The control unit 6 includes a central processing unit (CPU), a read only memory (ROM), a random access memory (RAM), and the like.

Next, an operation of the film conveyance section 27 when setting the film roll FR will be described. In the following description, an operation of each part is controlled by the control unit 6.

First, as illustrated in FIG. 1, the film roll FR is set on the second film roll support portion 23B. The film roll FR can be set on the second film roll support portion 23B by a robot (not illustrated) or the like.

When the film roll FR is set on the second film roll support portion 23B, the support frame 23C is rotated counterclockwise as illustrated in FIG. 2, and the film roll FR supported by the second film roll support portion 23B is moved upward. Specifically, the support frame 23C is rotated by, for example, 30°.

Subsequently, as illustrated in FIGS. 3, 4A, and 4B, the main body portion 41C of the detection portion 41 of the film roll detection unit 29 is moved forward and positioned at the contact position. Then, as illustrated in FIG. 5, the drive portion 39 of the film roll detection unit 29 is driven to move the base portion 37 forward. As a result, the contact portion 41A of the detection portion 41 is brought into contact with the film roll FR. When the contact portion 41A comes into contact with the film roll FR, the light shielding plate 41G shields the sensor 41D from light, and the sensor 41D outputs a detection signal. As a result, an operation of the drive portion 39 is stopped.

Figure 6:
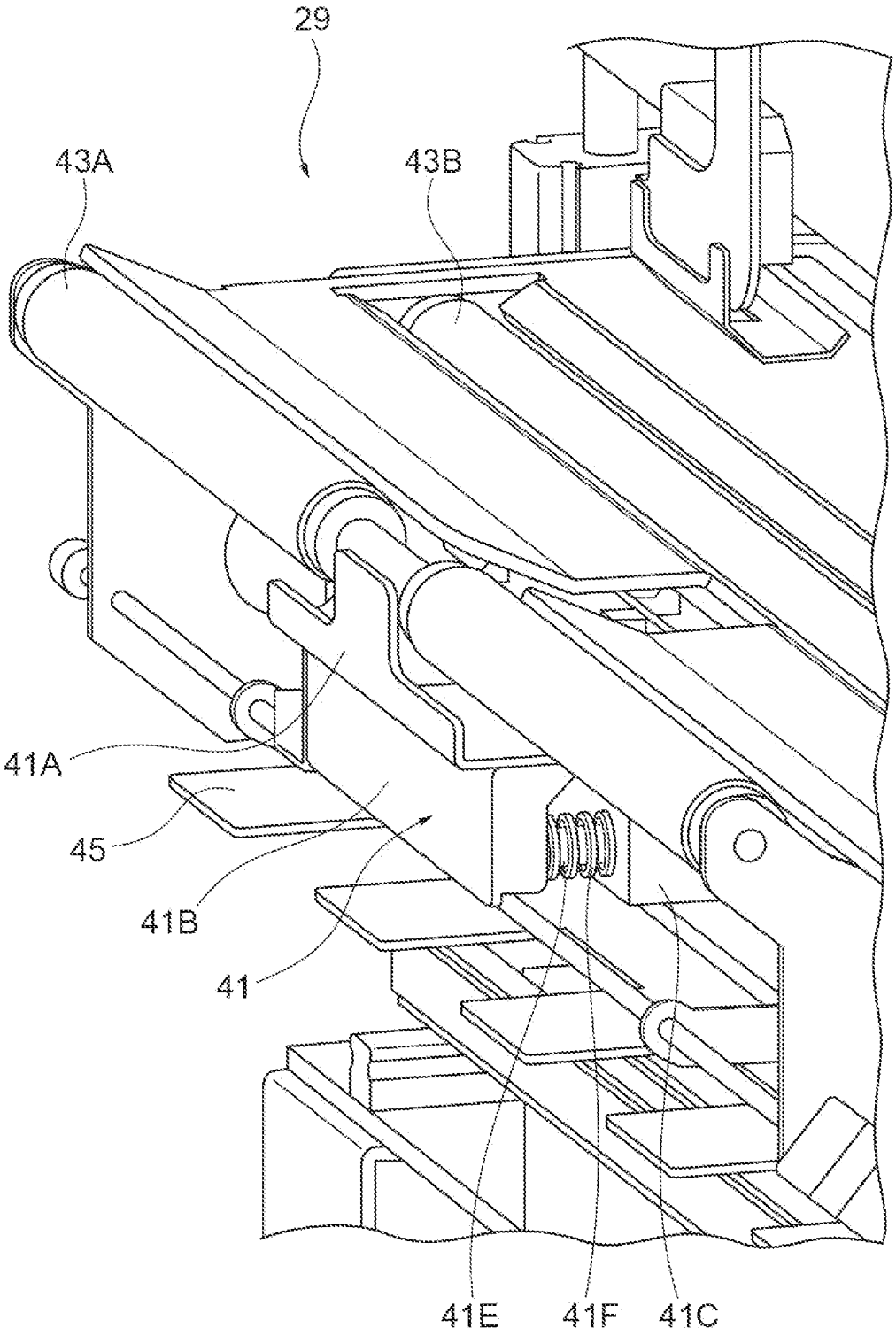
FIG. 6 is a perspective view illustrating the detection portion.

Next, as illustrated in FIG. 6, the main body portion 41C of the detection portion 41 is moved rearward and positioned at the origin position. Subsequently, the drive portion 39 is driven to move the base portion 37 forward by a predetermined distance. Then, the first clamping member 53A and the second clamping member 53B of the clamping portion 53 of the clamping unit 31 are moved to the clamping position P1.

Figure 7:
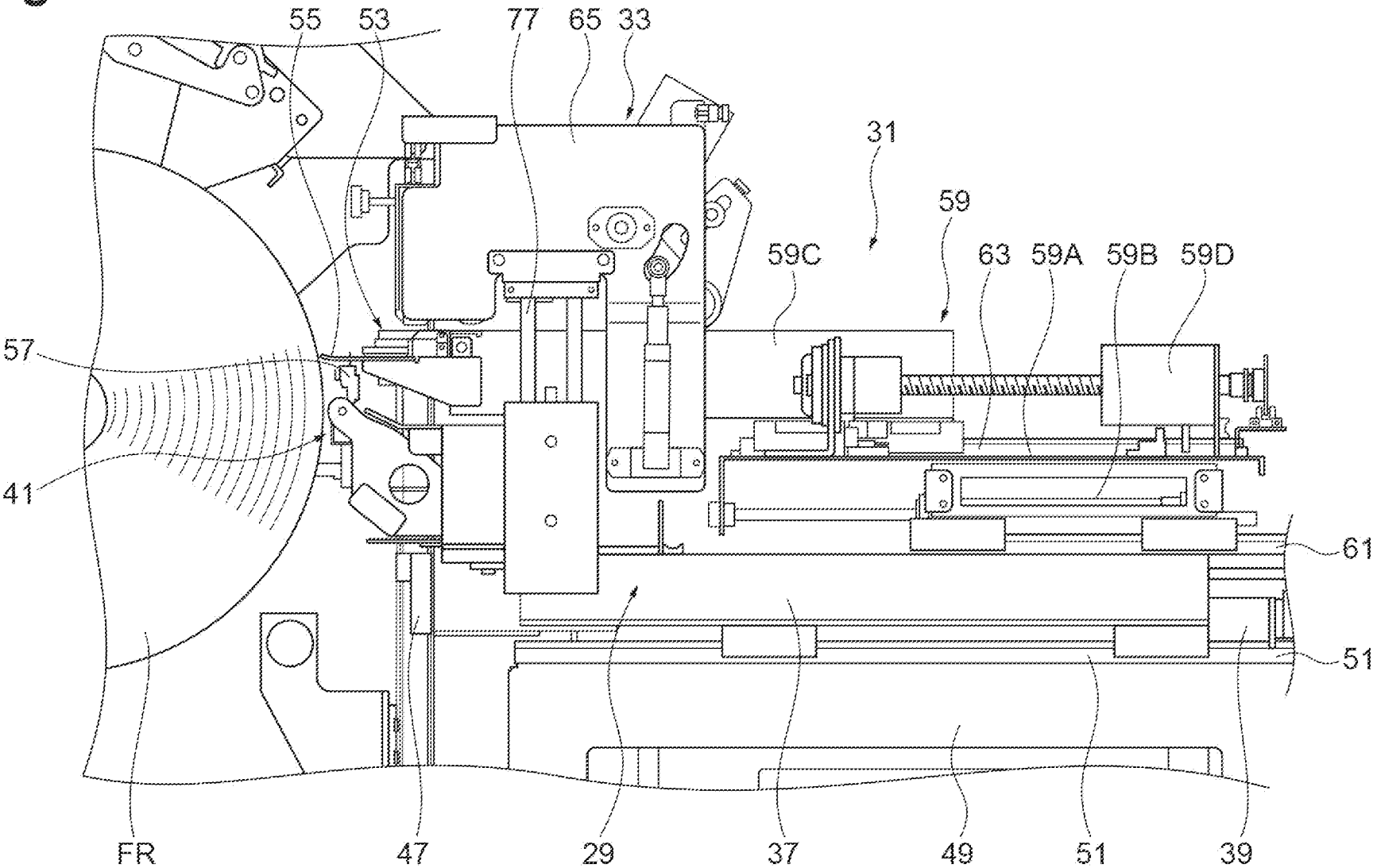
FIG. 7 is a side view illustrating a part of the bag-making and packaging machine.

That is, the first clamping member 53A and the second clamping member 53B are closed. In this state, as illustrated in FIG. 7, the first drive portion 59B and the second drive portion 59D of the pulling mechanism 59 of the clamping unit 31 are driven to move the clamping portion 53 forward.

Figure 8B:
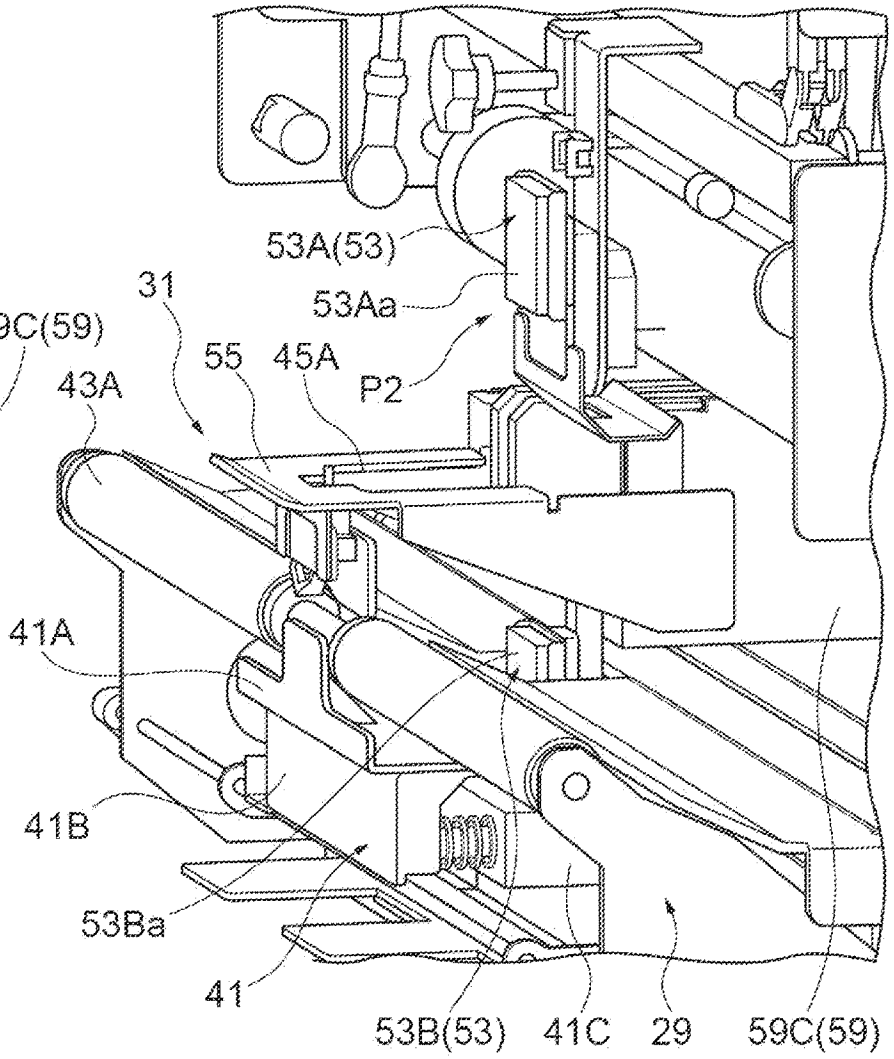
FIG. 8B is a perspective view illustrating a state of an open position of the clamping portion.
Figure 8A:
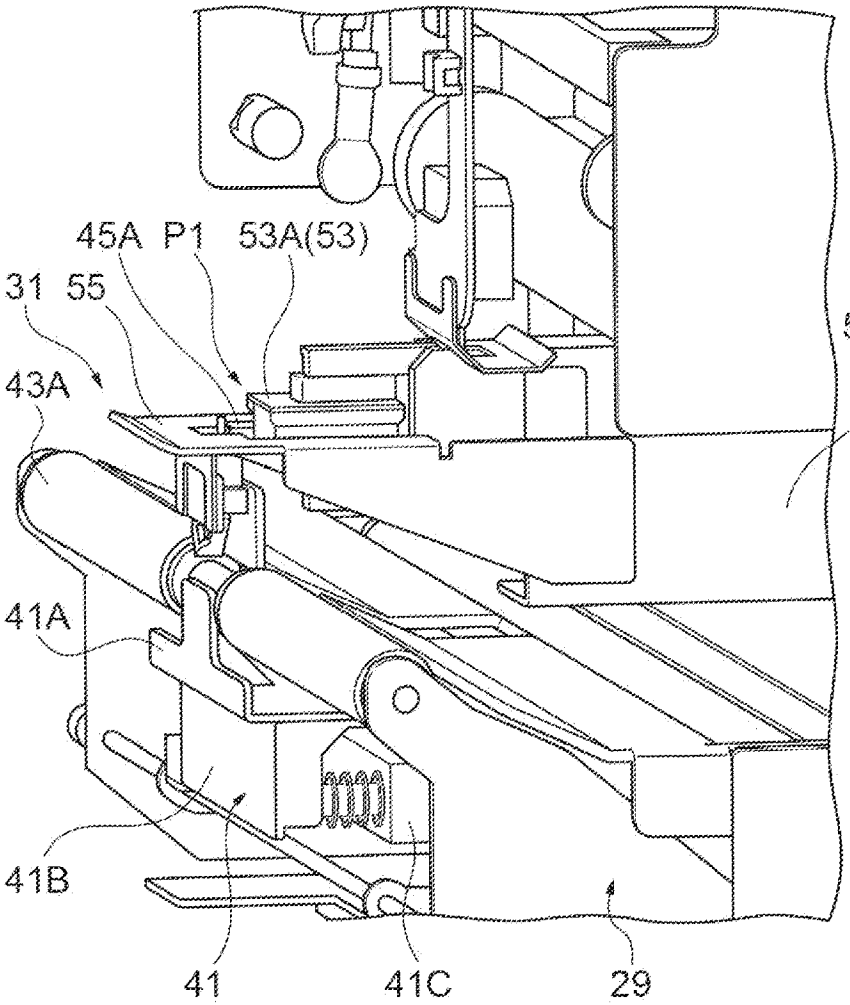
FIG. 8A is a perspective view illustrating a state of a clamping position of a clamping portion.

Subsequently, the first clamping member 53A and the second clamping member 53B are moved from the clamping position P1 illustrated in FIG. 8A to the open position P2 illustrated in FIG. 8B. Then, as illustrated in FIGS. 9A and 9B, the second film roll support portion 23B is rotated clockwise by the feeding mechanism.

Figure 10B:
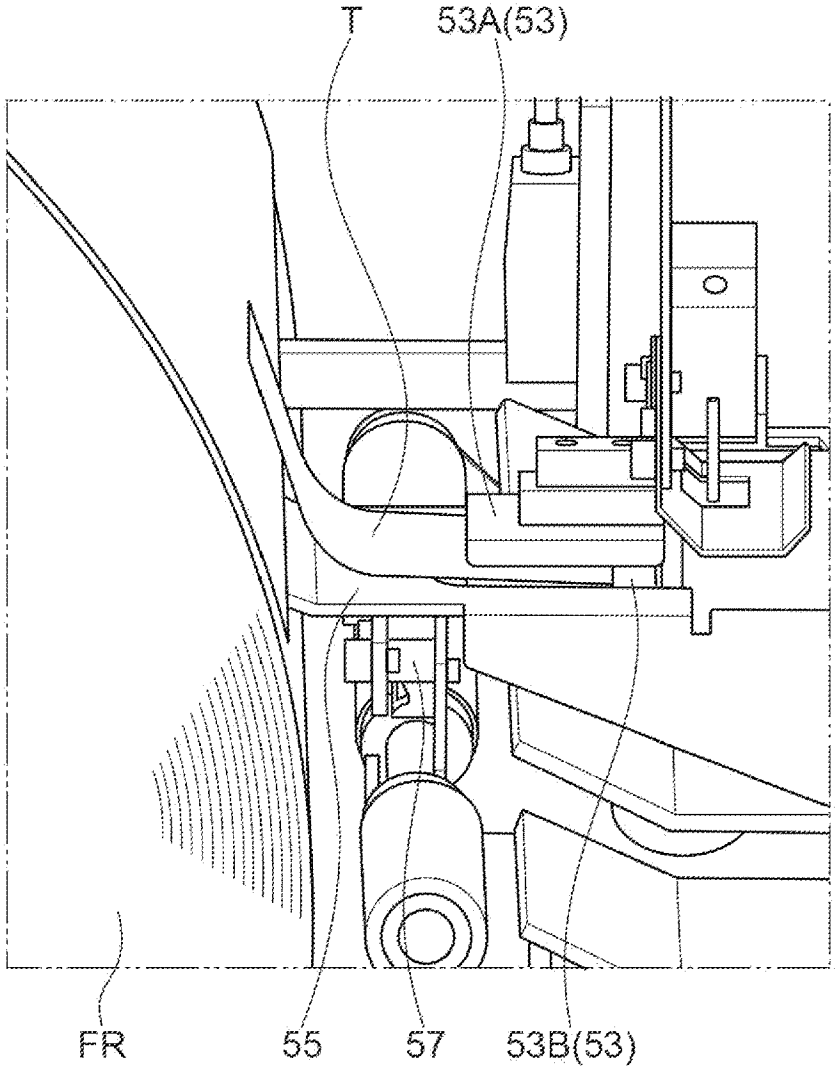
FIGS. 10A and 10B are views for describing clamping of a tape by the clamping portion.
Figure 10A:
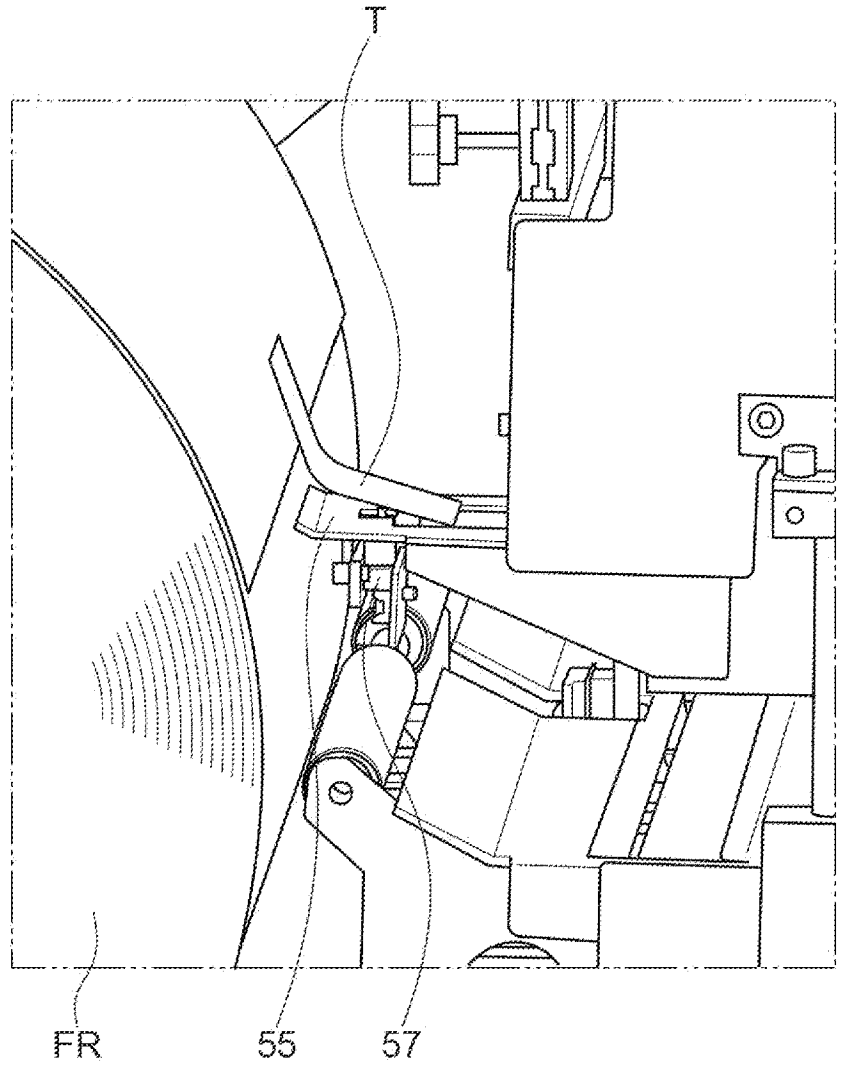

Subsequently, when the tape T is placed on the guide portion 55 and the sensor 57 detects the tape T as illustrated in FIG. 10A, the first clamping member 53A and the second clamping member 53B are moved to the clamping position P1 as illustrated in FIG. 10B. As a result, the tape T is clamped (held) by the clamping portion 53. At this time, the clamping portion 53 holds the tape T of the replacement film roll FR at a height position above the center of the diameter of the replacement film roll FR in the vertical direction.

Figure 11A:
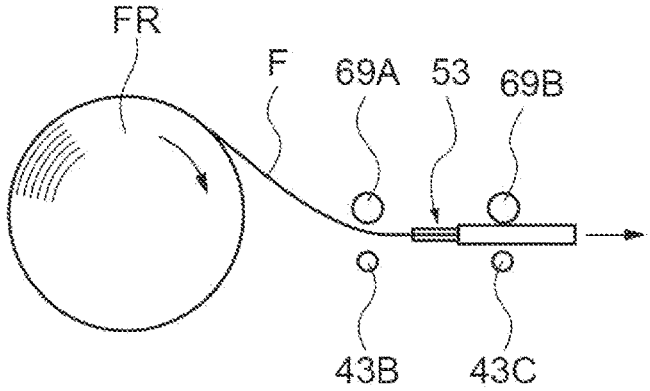
FIGS. 11A, 11B, 11C, and 11D are schematic views illustrating an operation of a film conveyance section.
Figure 11B:
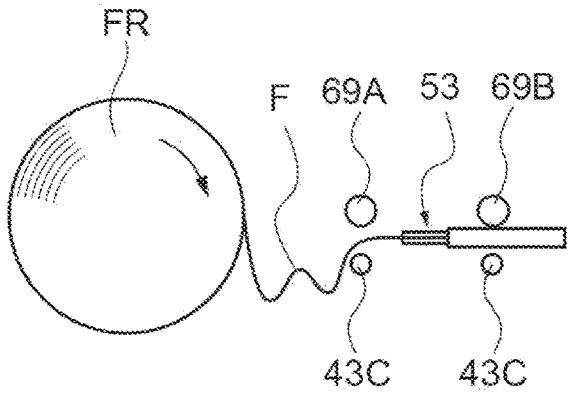

Subsequently, as illustrated in FIG. 11A, the first drive portion 59B and the second drive portion 59D of the pulling mechanism 59 are driven to move the clamping portion 53 rearward while the second film roll support portion 23B is rotated clockwise by the feeding mechanism. At this time, as illustrated in FIG. 11B, the second film roll support portion 23B is rotated to feed the second film F to be conveyed to the clamping unit 31. At this time, meandering of the second film F can be suppressed by equalizing the amount of feeding of the second film F by the second film roll support portion 23B and the amount of conveyance of the second film F in the clamping unit 31.

Figure 11C:
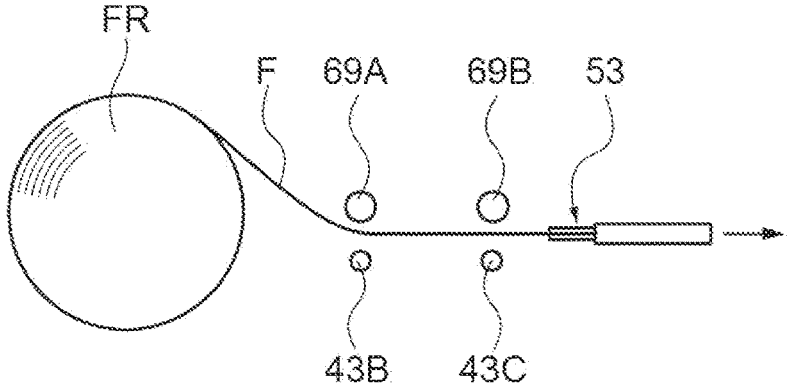
Figure 11D:
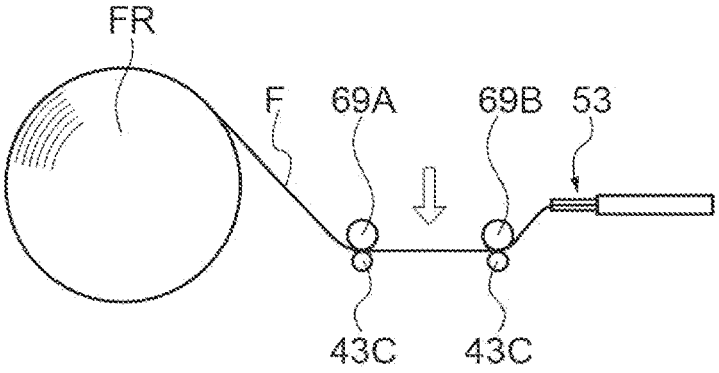

Next, as illustrated in FIG. 11C, the first drive portion 59B and the second drive portion 59D of the pulling mechanism 59 are driven to move the clamping portion 53 rearward to pull the second film F rearward. Then, the moving portion 77 of the roller unit 33 is turned off to move the main body portion 65 downward. Then, as illustrated in FIG. 11D, the rollers 69A and 69B are moved, the film F is clamped by the roller 69A and the roller 43B, and the second film F is clamped by the roller 69B and the roller 43C.

Subsequently, the drive portion 39 is driven to move the base portion 37 to the origin position while the second film roll support portion 23B is rotated clockwise by the feeding mechanism. Next, the support frame 23C is rotated clockwise to move the second film roll support portion 23B (film roll FR) from the position illustrated in FIG. 12 to the position illustrated in FIG. 13. At this time, the film delivery section 35 is also moved together, and when the film delivery section 35 is detected by the sensor 91, the movement is stopped.

Figure 14A:
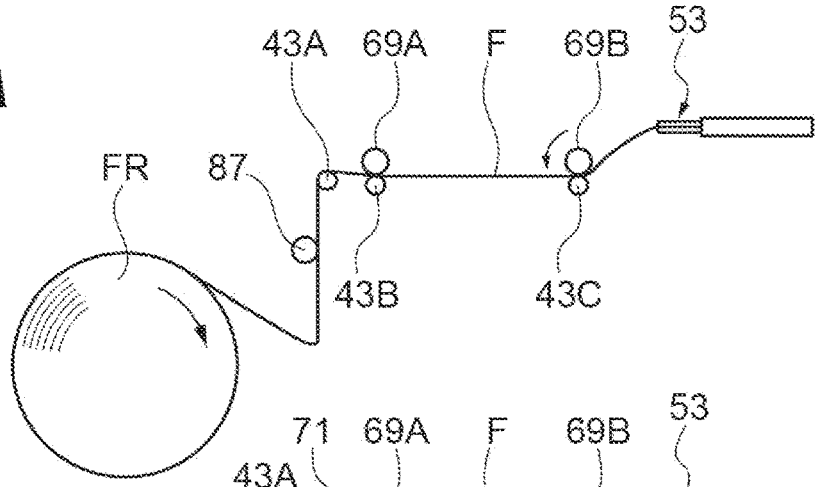
FIGS. 14A, 14B, 14C, and 14D are schematic views illustrating the operation of the film conveyance section.
Figure 14B:
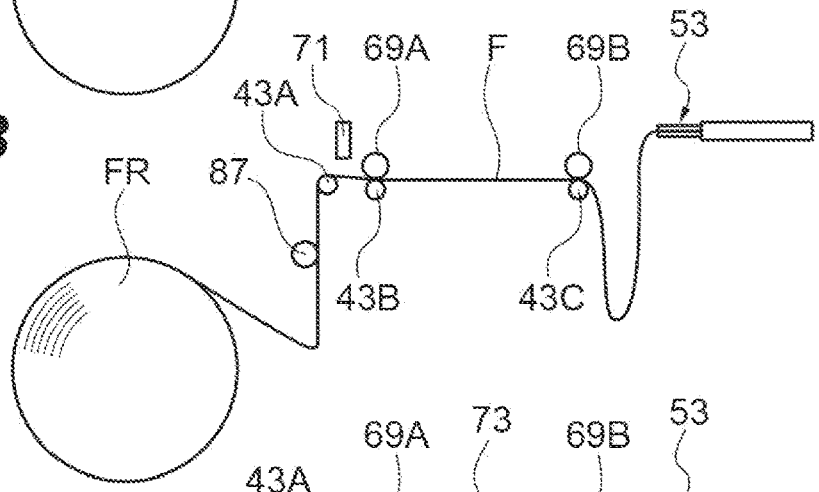

Subsequently, as illustrated in FIG. 14A, the roller 69B is rotated while the second film roll support portion 23B is rotated clockwise by the feeding mechanism. As illustrated in FIG. 14B, when the sensor 71 detects the registration mark M, the rotation of the roller 69B is stopped after the second film F having a predetermined length (for example, 50 mm) is pulled, and the rotation of the second film roll support portion 23B by the feeding mechanism is stopped.

Figure 14C:
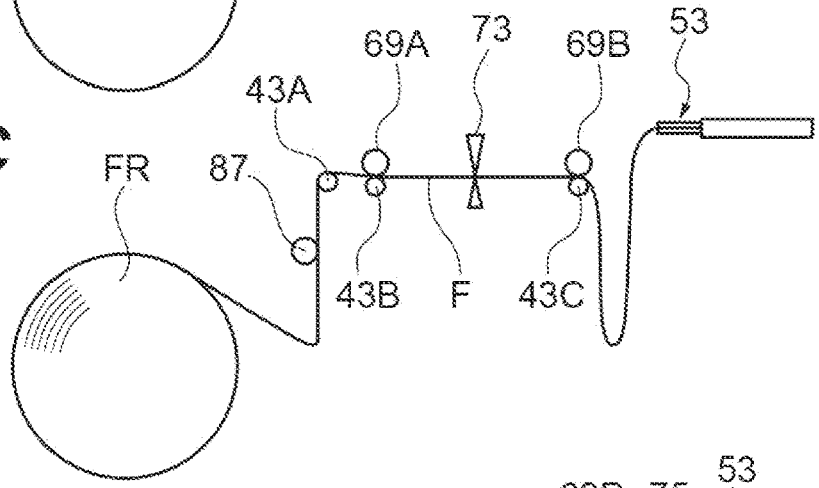
Figure 14D:
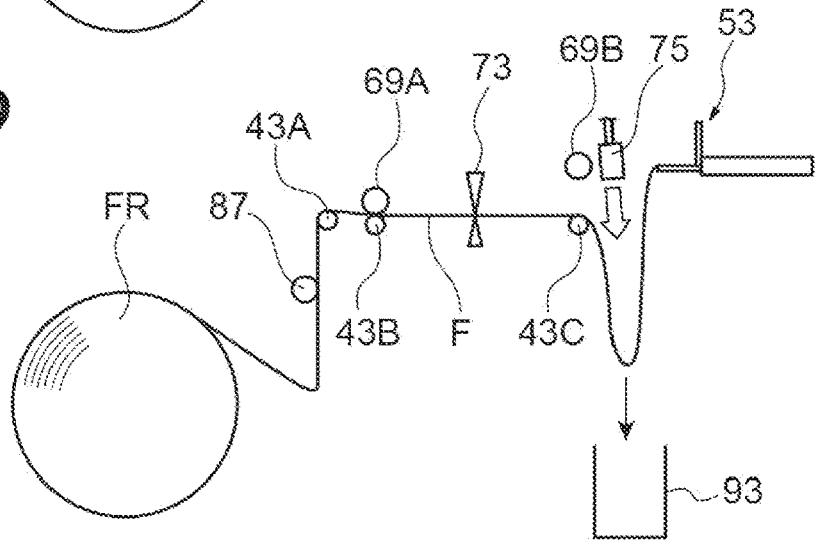

Subsequently, as illustrated in FIG. 14C, the cutter 73 is operated to cut the second film F. Then, as illustrated in FIG. 14D, the air injection portion 75 is operated to blow air onto the second film F. As a result, the second film F is discharged to a recovery portion 93 provided in the support frame 49.

Figure 15:
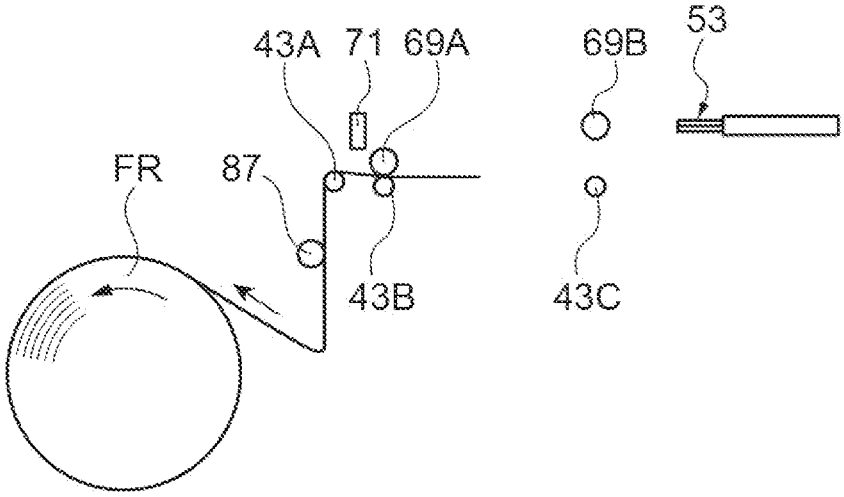
FIG. 15 is a schematic view illustrating the operation of the film conveyance section.

Subsequently, as illustrated in FIG. 15, the second film roll support portion 23B is rotated counterclockwise by the feeding mechanism, and the second film F is wound in the replacement film roll FR. When the sensor 71 detects the registration mark M, the rotation of the second film roll support portion 23B by the feeding mechanism is stopped.

Figure 16:
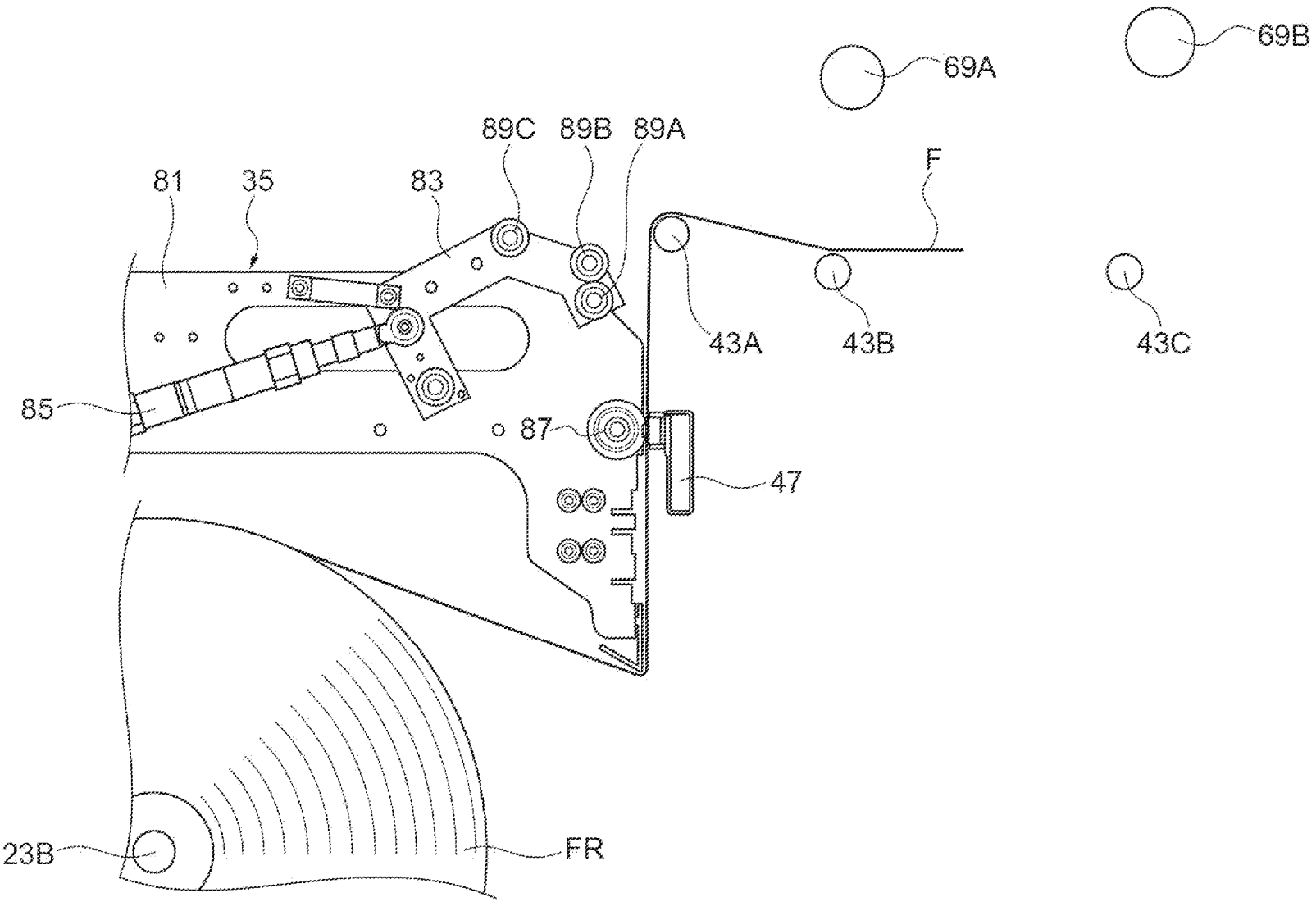
FIG. 16 is a side view illustrating the operation of the film conveyance section.

Subsequently, as illustrated in FIG. 16, the clamping portion 47 is moved forward, and the second film F is clamped by the roller 87 of the film delivery section 35 and the clamping portion 47. Further, the drive portion 85 is driven to swing the swinging portion 83, and the roller 89A is separated from the roller 87. The moving portion 77 of the roller unit 33 is driven to move the main body portion 65 upward. As a result, the roller 69A is separated from the roller 43B, and the clamping of the second film F by the roller 69A and the roller 43B is released.

Figure 17:
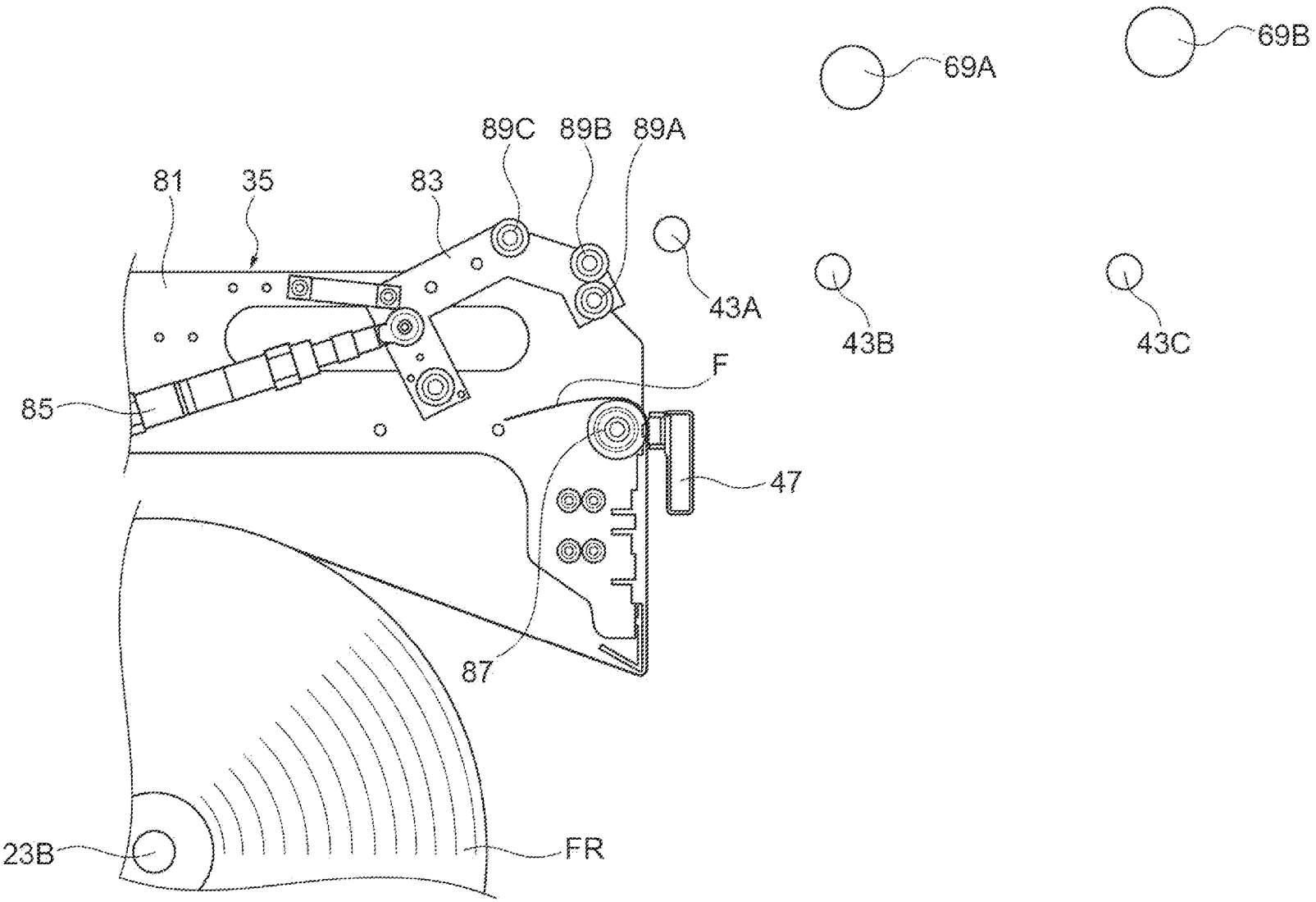
FIG. 17 is a side view illustrating the operation of the film conveyance section.
Figure 18:
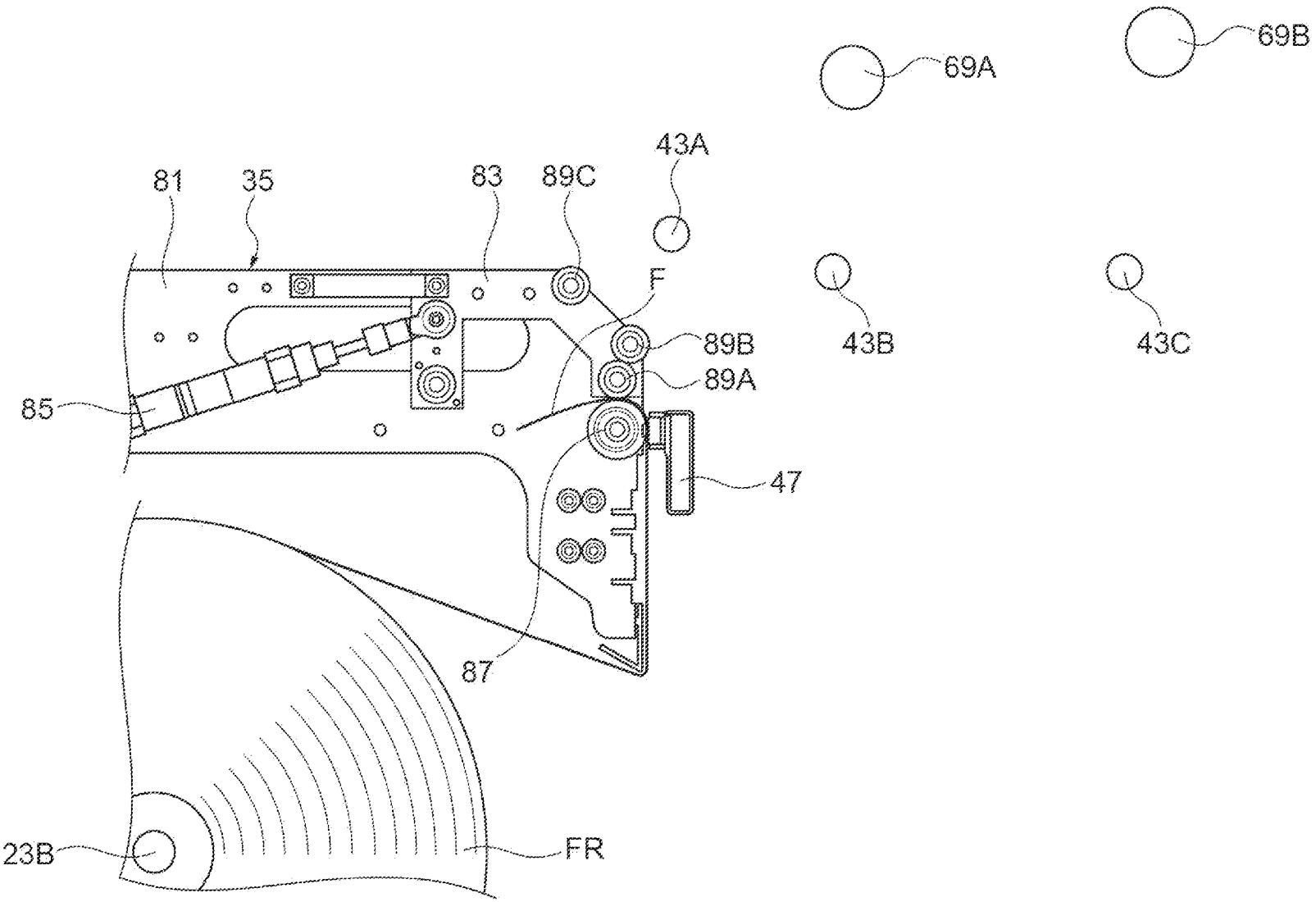
FIG. 18 is a side view illustrating the operation of the film conveyance section.

Subsequently, as illustrated in FIG. 17, air is injected from an air injection portion (not illustrated) provided in the film roll detection unit 29, and the second film F is hung on the roller 87. Then, as illustrated in FIG. 18, the drive portion 85 is driven to swing the swinging portion 83, and the roller 89A is brought close to the roller 87. As a result, the second film F is clamped by the roller 89A and the roller 87, and the second film F is held by the film delivery section 35. Next, the insertion portion 45 is moved forward, and the insertion portion 45 is inserted between the roller 89A and the roller 87. Thus, slack of the second film F is removed, and the second film F is stretched.

Figure 19:
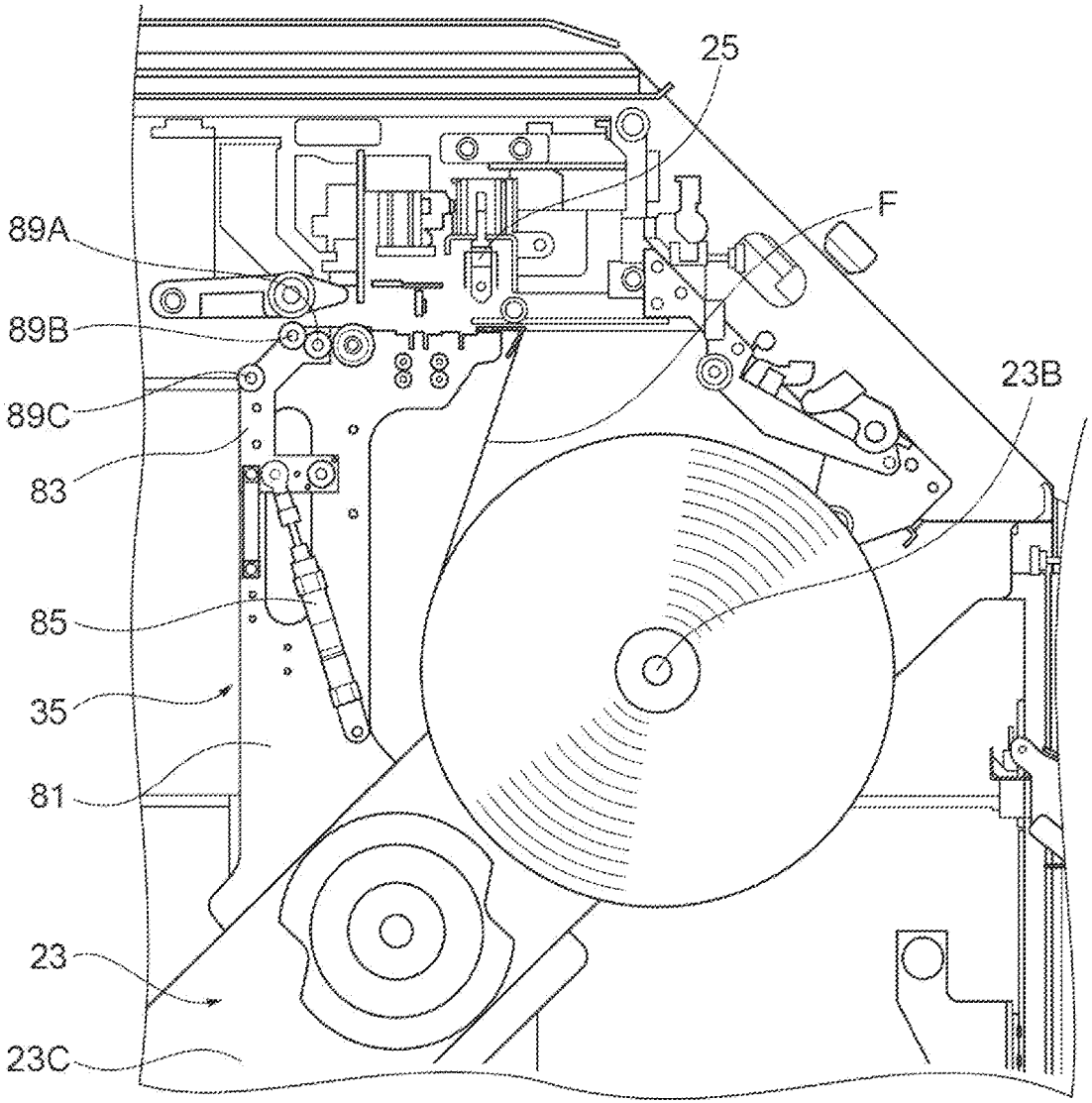
FIG. 19 is a side view illustrating the operation of the film conveyance section.

Subsequently, the insertion portion 45 is returned to the origin position. Further, the clamping portion 47 is moved rearward, and the clamping of the second film F by the roller 87 of the film delivery section 35 and the clamping portion 47 is released. Then, as illustrated in FIG. 19, the arm portion 81 of the film delivery section 35 is swung counterclockwise to convey the second film F to the bonding portion 25.

Next, an operation in a case where the tape T cannot be held by the clamping portion 53 (when the holding of the tape T fails) will be described with reference to FIGS. 21A, 21B, 21C, 21D, and 21E.

Figure 21A:
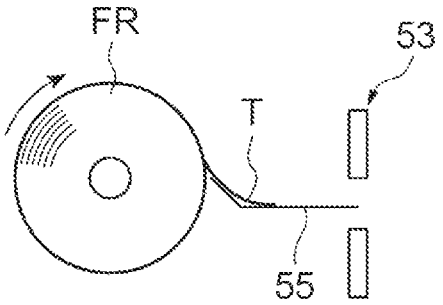
FIGS. 21A, 21B, 21C, 21D, and 21E are schematic views illustrating an operation when holding of a tape by the clamping portion fails.
Figure 21B:
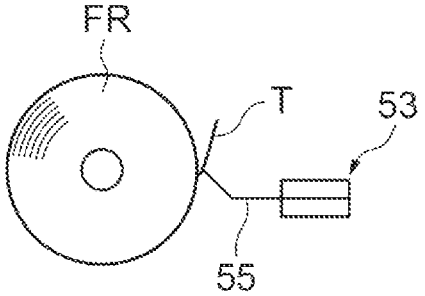

As illustrated in FIG. 21A, when the second film roll support portion 23B is rotated clockwise by the feeding mechanism, the tape T is placed on the guide portion 55, and the sensor 57 detects the tape T. The control unit 6 determines whether or not the tape T is held by the clamping portion 53 based on a detection result of the sensor 57. In a case where the sensor 57 does not detect the tape T as illustrated in FIG. 21B after a predetermined time has elapsed since the sensor 57 detected the tape T, the control unit 6 determines that the holding of the tape T has failed in the clamping portion 53. The predetermined time is a time set in advance such that the tape T reaches the clamping portion 53. The predetermined time is also a time from when the tape T is detected by the sensor 57 to when the clamping portion 53 is operated. That is, when the predetermined time elapses after the tape T is detected by the sensor 57, the clamping portion 53 is operated. The predetermined time (initial value) can be set based on a positional relationship between the sensor 57 and the clamping portion 53, or the like. The predetermined time can be set by an operation unit (for example, a touch panel display).

Figure 21C:
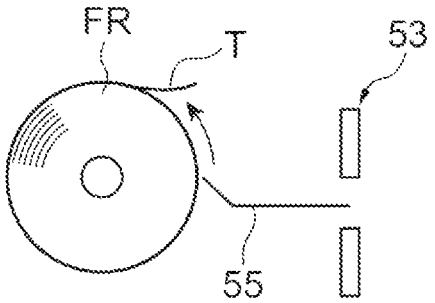

In a case where the control unit 6 determines that the holding of the tape T has failed in the clamping portion 53, the control unit 6 rotates the second film roll support portion 23B as illustrated in FIG. 21C in such a way that the tape T is detected again by the sensor 57. In the present embodiment, the control unit 6 rotates the second film roll support portion 23B counterclockwise. A rotation amount of the second film roll support portion 23B at this time is an amount by which the tape T is positioned on the guide portion 55. A rotational speed at which the second film roll support portion 23B is rotated counterclockwise may be the same as or higher than a rotational speed at which the second film roll support portion 23B is rotated clockwise (a speed at which the second film F is fed). The film roll FR is rotated counterclockwise by the rotation of the second film roll support portion 23B, and the tape T is positioned on the guide portion 55.

In a case where the control unit 6 determines that the holding of the tape T has failed in the clamping portion 53, the control unit 6 changes the predetermined time. In the present embodiment, the control unit 6 shortens the predetermined time (initial value). The shortened time may, for example, be 0.5 seconds. The control unit 6 operates the clamping portion 53 based on the changed predetermined time. The control unit 6 determines again whether or not the tape T is held by the clamping portion 53 based on a detection result of the sensor 57. In a case where the control unit 6 determines that the clamping portion 53 holds the tape T as illustrated in FIG. 21E, the control unit 6 returns the predetermined time to the initial value.

Figure 21D:
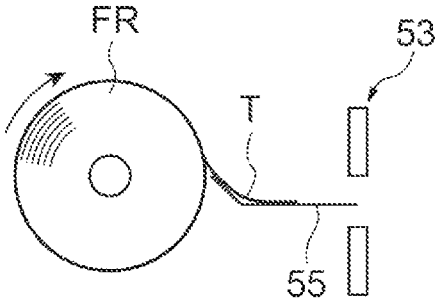
Figure 21E:
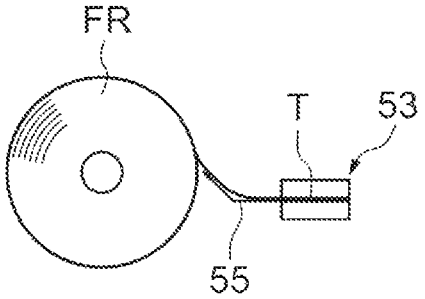

Subsequently, as illustrated in FIG. 21D, the control unit 6 again rotates the second film roll support portion 23B clockwise by the feeding mechanism in such a way that the tape T is detected again by the sensor 57. As a result, the tape T is placed on the guide portion 55 again, and the tape T is detected by the sensor 57 again.

In a case where the control unit 6 determines that the holding of the tape T has failed in the clamping portion 53, the control unit 6 further shortens the predetermined time and performs the operation described above again. The control unit 6 shortens the predetermined time every time it is determined that the holding of the tape T has failed in the clamping portion 53. In a case where the control unit 6 determines that the holding of the tape T has failed a predetermined number of times in the clamping portion 53, the control unit 6 stops the driving of the film roll support mechanism 23 (the second film roll support portion 23B). The predetermined number of times may, for example, be five times. In a case where the control unit 6 determines that the failure has occurred a predetermined number of times, the control unit 6 may perform control (displaying an alarm, a warning, or the like) to notify of the failure.

As described above, in the bag-making and packaging machine 1 according to the present embodiment, no work by an operator is required for the replacement of the replacement film roll FR. Therefore, in the bag-making and packaging machine 1, the replacement of the replacement film roll FR can be automatically performed.

Although the embodiment of the claimed invention has been described above, the claimed invention is not necessarily limited to the above-described embodiment, and various modifications can be made without departing from the gist thereof.

In the embodiment described above, a mode in which a holding portion is the clamping portion 53 has been described as an example. However, a mode in which the starting end portion of the replacement film roll FR or the tape T is held is not limited thereto. The starting end portion of the replacement film roll FR or the tape T may be held by other methods (for example, suction or the like).

In the embodiment described above, a mode in which the clamping portion 53 holds the tape T of the replacement film roll FR has been described as an example. However, the clamping portion 53 may hold the starting end portion of the replacement film roll FR.

In the embodiment described above, a mode in which, when the film roll FR is set on the second film roll support portion 23B, the support frame 23C is rotated counterclockwise, and the film roll FR supported by the second film roll support portion 23B is moved upward, has been described as an example. Here, the clamping portion 53 holds the tape T of the replacement film roll FR at a height position above the center of the diameter of the replacement film roll FR in the vertical direction. However, a moving mechanism that moves the clamping portion 53 in the vertical direction may be provided. With this configuration, the clamping portion 53 can be moved in the vertical direction, and thus, the clamping portion 53 can hold the starting end portion of the replacement film roll FR or the tape T at an appropriate height position.

In the embodiment described above, the clamping portion 53 may further include a roller disposed at a position facing the replacement film roll FR. With this configuration, when the clamping portion 53 holds the tape T of the replacement film roll FR, the roller can suppress breakage or the like of the replacement film roll FR.

In the embodiment described above, a mode in which the film roll support mechanism 23 includes the first film roll support portion 23A and the second film roll support portion 23B has been described as an example. However, the number of film roll support portions may be one. In this case, when the amount of the first film F of the used film roll FR supported by the film roll support portion becomes equal to or less than a predetermined amount, the used film roll FR is removed from the film roll support portion while leaving a predetermined amount of the first film F1, and the replacement film roll FR is attached to the film roll support portion.

In the embodiment described above, a mode in which the control unit 6 shortens the predetermined time in a case where the control unit 6 determines that the holding of the tape T has failed in the clamping portion 53 has been described as an example. However, the control unit 6 may extend the predetermined time.

In the embodiment described above, a mode in which the control unit 6 rotates the second film roll support portion 23B counterclockwise as illustrated in FIG. 21C in such a way that the tape T is detected again by the sensor 57, has been described as an example. However, the control unit 6 may rotate the second film roll support portion 23B clockwise in such a way that the tape T is detected again by the sensor 57.

In the embodiment described above, a mode in which the control unit 6 changes the predetermined time in a case where the control unit 6 determines that the holding of the tape T has failed in the clamping portion 53 has been described as an example. However, in a case where the control unit 6 determines that the holding of the tape T has failed in the clamping portion 53, the control unit 6 may change a speed of feeding of the film F from the second film roll support portion 23B. Specifically, the speed of feeding may be increased.

We claim:

1. A bag-making and packaging machine, comprising:

a bag-making and packaging section configured to form a sheet-form film into a tubular shape and to seal the film formed into a tubular shape to form the film into a bag shape; and a film supply section configured to hold a film roll in which the sheet-form film is wound and sequentially supply the film fed from the film roll to the bag-making and packaging section, wherein the film supply section includes a film roll support portion configured to rotatably support the film roll, a bonding portion configured to bond a terminal end portion of the film roll that supplies the film to the bag-making and packaging section and a starting end portion of a film roll for replacement, and a film conveyance section configured to convey the starting end portion of the film roll for replacement supported by the film roll support portion to the bonding portion, the film conveyance section includes a holding portion configured to hold the starting end portion of the film roll for replacement or a tape adhering to the starting end portion, and a pulling portion configured to pull the film held by the holding portion from the film roll, the film roll support portion rotates the film roll when the film roll for replacement is mounted, and the holding portion holds the starting end portion of the film roll rotated by the film roll support portion or the tape.

2. The bag-making and packaging machine according to claim 1, further comprising a detection portion configured to detect a mark for position adjustment provided on the film roll for replacement; and a control unit configured to stop conveyance of the film in the film conveyance section based on a detection result of the detection portion.

3. The bag-making and packaging machine according to claim 2, wherein after the conveyance of the film by the film conveyance section is stopped, the starting end portion of the film is cut, and the holding of the film by the holding portion is released.

4. The bag-making and packaging machine according to claim 1, wherein the holding portion holds the starting end portion of the film roll or the tape at a height position above a center of a diameter of the film roll for replacement in a vertical direction.

5. The bag-making and packaging machine according to claim 1, further comprising a moving mechanism configured to move the holding portion in a vertical direction.

6. The bag-making and packaging machine according to claim 1, wherein the film conveyance section further includes a guide portion configured to guide the starting end portion of the film roll or the tape to the holding portion, and the guide portion is subjected to non-adhesive processing.

7. The bag-making and packaging machine according to claim 1, wherein the holding portion includes a roller disposed at a position facing the film roll.

8. The bag-making and packaging machine according to claim 1, wherein the film supply section feeds the film from the film roll by rotating the film roll support portion, the film conveyance section further includes a guide portion configured to guide the film fed by the film supply section or the tape adhering to the film, and a detection portion configured to detect the film or the tape guided on the guide portion, the holding portion holds the film or the tape guided on the guide portion and pulls the film from the film roll, the bag-making and packaging machine further comprises a control unit configured to control rotation of the film roll support portion, and in a case where the control unit determines that the holding of the film or the tape has failed in the holding portion based on a detection result of the detection portion, the control unit rotates the film roll support portion in such a way that the film or the tape is detected again by the detection portion.

* * * * *